US007502037B2

(12) United States Patent
Okamoto

(10) Patent No.: US 7,502,037 B2
(45) Date of Patent: Mar. 10, 2009

(54) DISPLAY ELEMENT AND GRAY SCALE DRIVING METHOD THEREOF

(75) Inventor: Shigetsugu Okamoto, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 1304 days.

(21) Appl. No.: 10/217,484

(22) Filed: Aug. 14, 2002

(65) Prior Publication Data

US 2003/0142056 A1 Jul. 31, 2003

(30) Foreign Application Priority Data

Oct. 25, 2001 (JP) ..... 2001-328285

(51) Int. Cl.
*G09G 5/10* (2006.01)

(52) U.S. Cl. ..... 345/690; 345/92; 345/206; 345/691; 345/692; 345/693

(58) Field of Classification Search ..... 345/92, 345/206, 690, 691–693
See application file for complete search history.

(56) References Cited

U.S. PATENT DOCUMENTS 6,052,112 A 4/2000 Tanaka et al.
6,084,561 A 7/2000 Kudo et al.
6,154,189 A 11/2000 Tamura et al.
6,208,467 B1 * 3/2001 Naka et al. ..... 359/618
6,222,510 B1 4/2001 Etoh
6,661,397 B2 12/2003 Mikami et al.
6,788,282 B2 * 9/2004 Ito ..... 345/103
6,791,523 B2 * 9/2004 Fujita et al. ..... 345/92
6,937,222 B2 * 8/2005 Numao ..... 345/98
2004/0085269 A1 5/2004 Mikami et al.

FOREIGN PATENT DOCUMENTS

JP 1-163795 A 6/1989

(Continued)

OTHER PUBLICATIONS

Korean Office Action and English translation thereof mailed Mar. 8, 2005 in corresponding Korean application No. 10-2002-49843.

(Continued)

*Primary Examiner*—Richard Hjerpe
*Assistant Examiner*—Leonid Shapiro
(74) *Attorney, Agent, or Firm*—Nixon & Vanderhye P.C.

(57) ABSTRACT

A display element 1, provided at each point of intersections of a plurality of signal lines and a plurality of scanning lines, includes an optical modulation element 5 and an active element 2, wherein, when a scanning is carried out not less than once in one field period at a predetermined intervals, a memory element 3 which can store M-bit (M≧1) information at the maximum is provided so that the optical modulation element 5 keeps the display with $2^M$-level gray scale until the next scanning. On this account, it is possible to supply gray scale signal data Dm to the optical modulation element 5 so as to keep the display condition, without attenuating the data after the scanning of pixels. Moreover, since the level of the gray scale display is kept by outputting the information stored in the memory element 3, the gray scale level in each time division sub field can be in concordance with the number of memory bits.

13 Claims, 17 Drawing Sheets

FOREIGN PATENT DOCUMENTS

| | | | |
|---|---|---|---|
| JP | 2-148687 | A | 6/1990 |
| JP | 7-253764 | A | 10/1995 |
| JP | 8-129359 | A | 5/1996 |
| JP | 8-194205 | A | 7/1996 |
| JP | 9-83911 | A | 3/1997 |
| JP | 9-172589 | A | 6/1997 |
| JP | 9-212140 | A | 8/1997 |
| JP | 10-124001 | A | 5/1998 |
| JP | 10-171400 | A | 6/1998 |
| JP | 11-2797 | A | 1/1999 |
| JP | 11-75144 | A | 3/1999 |
| JP | 11-212516 | A | 8/1999 |
| JP | 11-295700 | A | 10/1999 |
| JP | 2000-56727 | A | 2/2000 |
| JP | 2000-267617 | A | 9/2000 |
| JP | 2000-284751 | A | 10/2000 |
| JP | 2000-310980 | A | 11/2000 |
| JP | 2000-347624 | A | 12/2000 |
| JP | 2001-33760 | A | 2/2001 |
| JP | 2001-100707 | A | 4/2001 |
| JP | 2001-159883 | A | 6/2001 |
| JP | 2002-132217 | A | 5/2002 |
| JP | 2002-202755 | A | 7/2002 |
| KR | 1997-0076455 | | 12/1997 |
| KR | 1998-33102 | | 10/1998 |
| TW | 294807 | | 1/1997 |
| TW | 320715 | | 11/1997 |
| WO | 01/29814 | A1 | 4/2001 |

OTHER PUBLICATIONS

Korean Office Action and English translation thereof mailed Jul. 21, 2005 in corresponding Korean application No. 10-2002-49843.

Japanese Notice of Reasons for Refusal and English translation thereof mailed Oct. 25, 2005 in corresponding Japanese application No. 2001-328285.

Taiwanese Office Action and English translation thereof mailed Jun. 7, 2004 in corresponding Taiwanese Application No. 091118422.

* cited by examiner

DISPLAY ELEMENT AND GRAY SCALE DRIVING METHOD THEREOF

FIELD OF THE INVENTION

The present invention relates to (i) a display element such as an optical modulation element provided in a display device such as a liquid crystal display panel, and (ii) a gray scale driving method thereof, and particularly relates to a display element being capable of reducing the load of a driver and carrying out excellent multi-level gray scale display, and a gray scale driving method thereof.

BACKGROUND OF THE INVENTION

Regarding the gray scale driving method of a display element such as an optical modulation element, many types of display devices have conventionally adopted a device arrangement or a multi-level gray scale driving method for carrying out multi-level gray scale display.

For instance, Japanese Laid-Open Patent Application No. 2000-347624 (Tokukai 2000-347624; published on Dec. 15, 2000), Japanese Laid-Open Patent Application No. 2000-284751 (Tokukai 2000-284751; published on Oct. 13, 2000), and Japanese Laid-Open Patent Application No. 8-129359/1996 (Tokukaihei 8-129359; published on May 21, 1996) disclose gray scale display means of a display element of a conventional electroluminescence display device.

The gray scale display means defined in the publications above is arranged such that TFTs for driving a display element are connected in parallel with each other, and the multi-level gray scale display is carried out by controlling the electric conductivity of each TFT.

Also, Japanese Laid-Open Patent Application No. 2000-310980 (Tokukai 2000-310980; published on Nov. 7, 2000) discloses a method of realizing the maximum-level gray scale by converting the input gate voltage of a drive TFT to multi-level and carrying out a time division gray scale driving.

In this arrangement adopting the time division gray scale driving method, the optical modulation element itself carries out precise analog gray scale driving.

However, the conventional multi-level gray scale driving methods carrying out the analog gray scale driving have a problem such that the fluctuation of the output current due to the fluctuation of the gate input voltage of the drive TFT causes the occurrence of significant luminous transition in the display, since the element emits light by the current control.

Thus, to solve this problem of the luminance transition, the multi-level gray scale display has recently been realized by adopting binary drive which has few problems with the stability of output luminance control, and time-dividing the binary display.

However, if the conventional multi-level gray scale driving method in which the binary display is time-divided is adopted, a display device such as a plasma display device, which is intrinsically able to carry out only the binary display, controls sub fields corresponding to the bit weight of each gray scale signal information by adopting the time division method. On this account, a dynamic false contour is generated and hence the multi-level gray scale display cannot be properly carried out.

This dynamic false contour becomes visible owing to the synergistic effect of (i) the amount of travel of the luminous barycenter within the field period being maximized in the field period of the greatest weight and (ii) the luminous barycenter and the sight line of the viewer moving in accordance with the movement of images, and hence the image quality is degraded.

To solve this degradation of the image quality due to the occurrence of the dynamic false contour, for instance, Japanese Laid-Open Patent Application No. 9-83911/1997 (Tokukaihei 9-83911; published on Mar. 28, 1997) and Japanese Laid-Open Patent Application No. 10-124001/1998 (Tokukaihei 10-124001; published on May 15, 1998) disclose a display device which carries out the time division gray scale driving of the binary display, such as a plasma display device, etc.

In the display device defined in the publications above, a display element can independently carry out gray scale display of 2-4 bits precisely. However, to realize the maximum-level gray scale display, it is necessary to restrain the occurrence of the dynamic false contour under the limit, while carrying out the time division display. Thus, this display device has time division periods provided in a plurality of sub fields which exceed the number of display bits, so that the occurrence of the dynamic false contour is restrained.

However, since the display devices of the publications above require the transfer of a gray scale signal of each bit to the pixels in each scanning, the number of driving of the driver for gray scale drive provided in the display device increases, and this puts a load on the driver for gray scale drive.

Moreover, in accordance with the increase of the number of driving of the driver for gray scale drive, the power consumption of the display device also increases.

SUMMARY OF THE INVENTION

The objective of the present invention is to provide a display element which is capable of: reducing the load of a driver for gray scale drive of a display device; decreasing the power consumption; and carrying out excellent multi-level gray scale display, and a gray scale driving method thereof.

To achieve the objective above, the display element in accordance with the present invention, provided at each point of intersections of a plurality of signal lines and a plurality of scanning lines, includes: an optical modulation element; an active element; storage means for storing M-bit ($M \geqq 1$) information at a maximum, when a scanning is carried out at least once at predetermined intervals in one field period; gray scale display keeping means for making the optical modulation element keep a display with $2^M$-level gray scale based on gray scale signal information stored in the storage means, until a subsequent scanning is carried out.

According to this arrangement, since the storage means storing M-bit information is provided, the gray scale display keeping means can keep the display condition without attenuating the display data after the scanning of pixels.

That is to say, when scanning for displaying moving images is carried out, the display element in accordance with the present invention carries out the display each time the scanning is conducted, and the gray scale signal information obtained by each scanning is stored in the storage means. On this account, it is possible to send the gray scale signal information from the storage means to the optical modulation element, and hence the display of the optical modulation element can keep the display with $2^M$-level gray scale.

Thus, since it is unnecessary to resend the gray scale signal information for keeping the display of the optical modulation element after the scanning, the driver for gray scale drive can be made inactive so that the load of the driver can be reduced. Moreover, since the frequency of transferring the gray scale signal data and the frequency of outputting the scanning signals can be decreased, the power consumption of the display device can be reduced.

For a fuller understanding of the nature and advantages of the invention, reference should be made to the ensuing detailed description taken in conjunction with the accompanying drawings.

DESCRIPTION OF THE EMBODIMENTS

Embodiment 1

The following description will discuss an embodiment of a display element and a gray scale driving method thereof in accordance with the present invention, in reference to FIGS. 1 through 11.

Figure 1:
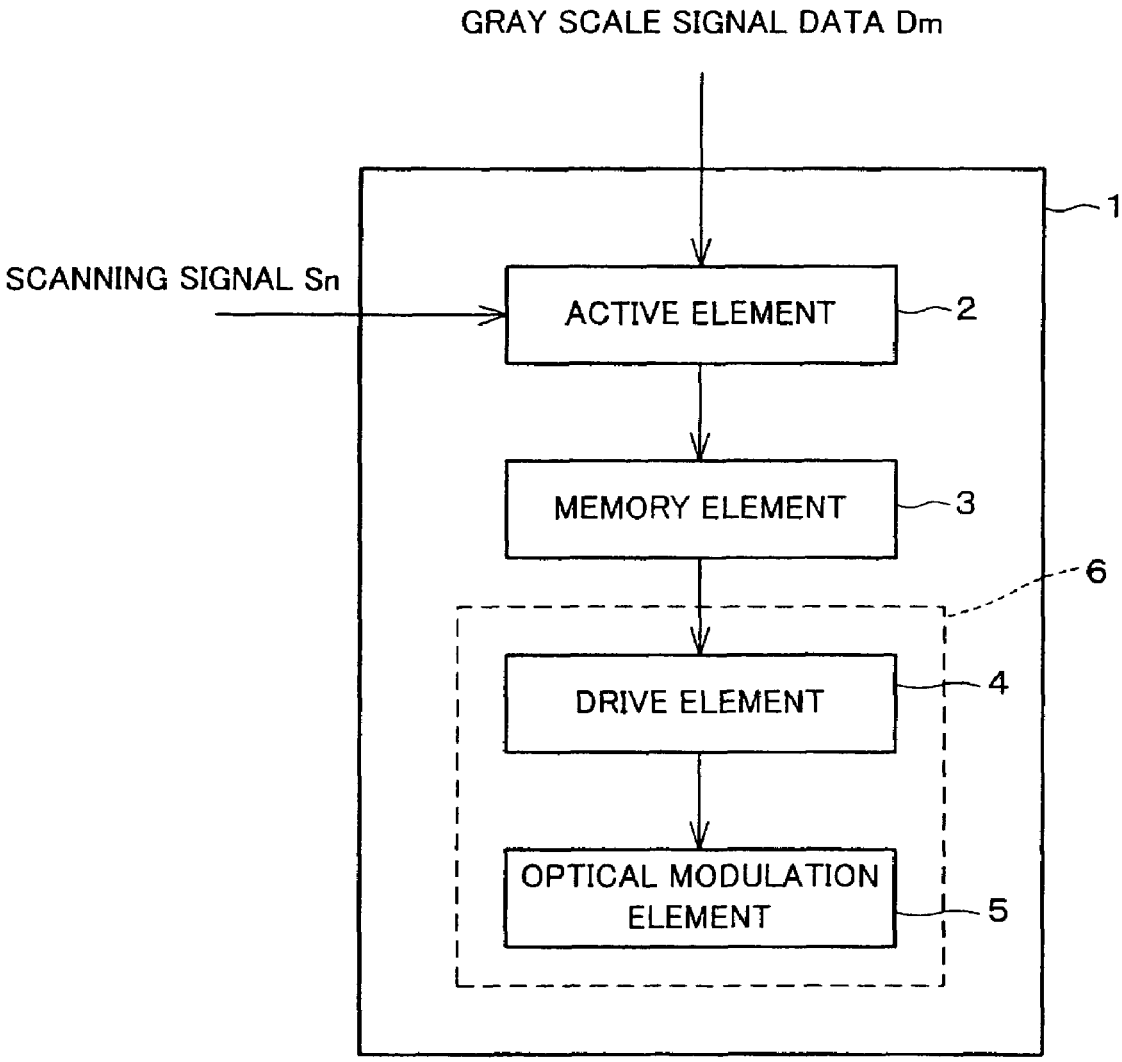
FIG. 1 is a conceptual diagram, indicating signal paths in a display element in accordance with an embodiment of the present invention.

As FIG. 1 illustrates, the display element in accordance with the present invention carries out gray scale driving according to a basic block conceptual diagram of each pixel of a matrix in a display device such as an electroluminescence display device and a liquid crystal display device.

A display element 1 at coordinates (n, m) in the screen of the display device includes, as FIG. 1 illustrates, an active element 2 which is used at the time of selecting a pixel, a memory element (storage means) 3, and a block 6, and the block 6 further includes a drive element 4 and an optical modulation element 5.

In the display element 1, N-bit data is outputted from gray scale signal data Dm when a scanning signal Sn is selected, and the data is stored in the memory element 3.

To the active element 2, the scanning signal Sn and the gray scale signal data Dm are supplied, and from the active element 2, image information is supplied to the memory element 3.

The memory element 3 receives the gray scale signal data Dm from the active element 2, so as to store the gray scale signal data Dm and supply the same to the drive element 4.

The drive element 4 regulates a drive TFT load (not illustrated) in accordance with the setting of the memory element 3 when the scanning signal Sn is not selected, so as to regulate the output of the optical modulation element 5.

The optical modulation element 5 receives the output from the drive element 4, and outputs the light in accordance with the gray scale signal data Dm.

For instance, when the memory element has M-bit capacity, the block 6 provided with the drive element 4 and the optical modulation element 5 can output the light with $2^M$-level gray scale.

Now, referring to FIG. 2, the scanning timing of the display element which carries out 16-level gray scale display in one field period using a 2-bit memory element 3 will be described as follows.

First of all, provided that the temporal ratio of scanning 7 to scanning 8 is set as 1:4, and lines are serially scanned, when each of the lines is selected, the memory element 3 stores the signal information of bits b0 and b1 in the scanning 7, and at the same time, the display in accordance with this signal information is carried out. The memory element 3 stores the signal information of bits b2 and b3 in the scanning 8, and at the same time, the display in accordance with this signal information is carried out. The optical power of the display element at this moment is an optical level of 0, 1, 2, or 3, since the 2-bit memory element 3 is adopted.

As described above, the memory element 3 stores the gray scale signal data Dm in each scanning, and at the same time the display in accordance with the gray scale signal data Dm is carried out, so that it is possible to transmit the gray scale signal data Dm to the optical modulation element 5 without attenuating the data which is kept after the scanning of the pixels, so as to keep the quality of the display. Moreover, since the information stored in the memory element 3 is outputted and the gray scale display is retained, it is possible to display the luminous intensity with the gray scale level corresponding to the number of memory bits, in each of the time division display periods.

Figure 3:
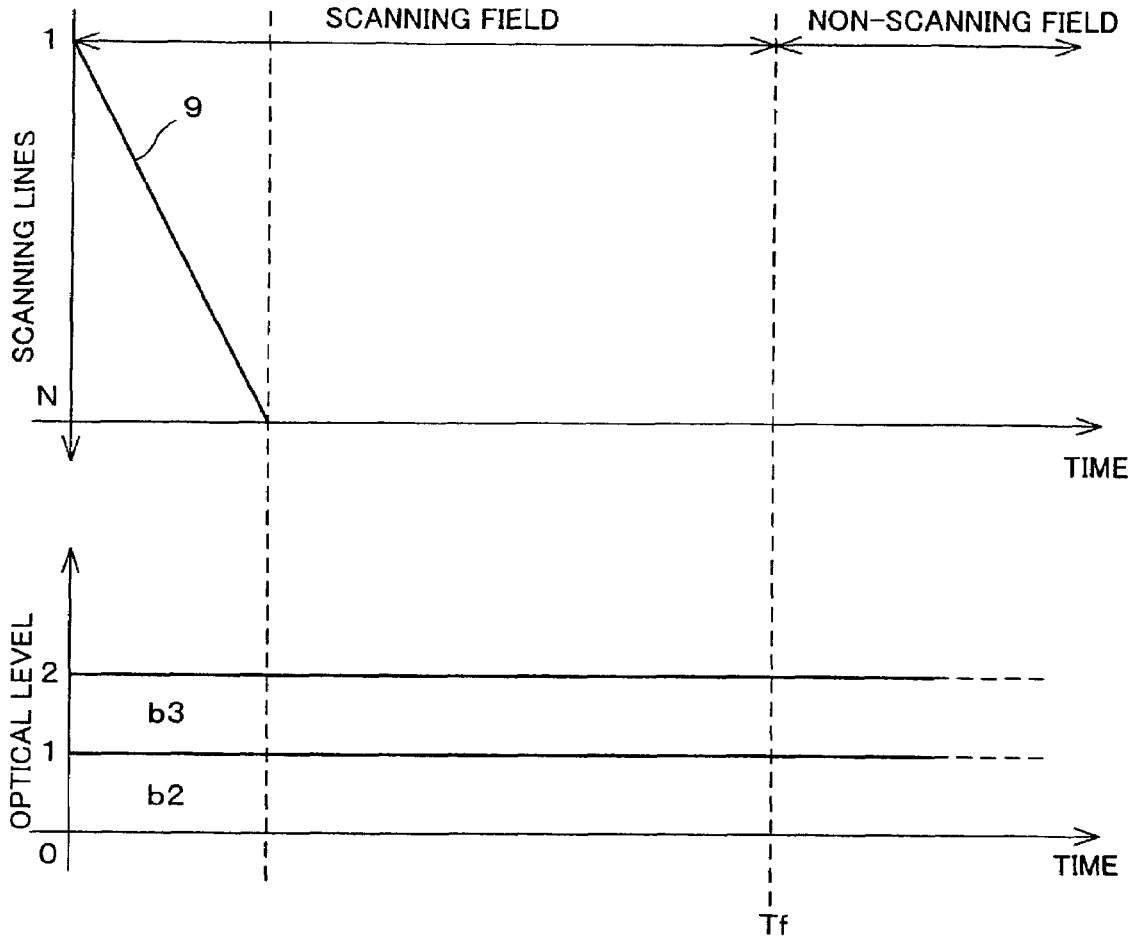
FIG. 3 is an explanatory view of scanning, indicating the driving when the display element of FIG. 1 carries out 2-bit gray scale driving using 2-bit gray scale pixels therein.

Moreover, when the gray scale display is carried out using a non-scanning output, the scanning timing is arranged as illustrated in FIG. 3.

Figure 2:
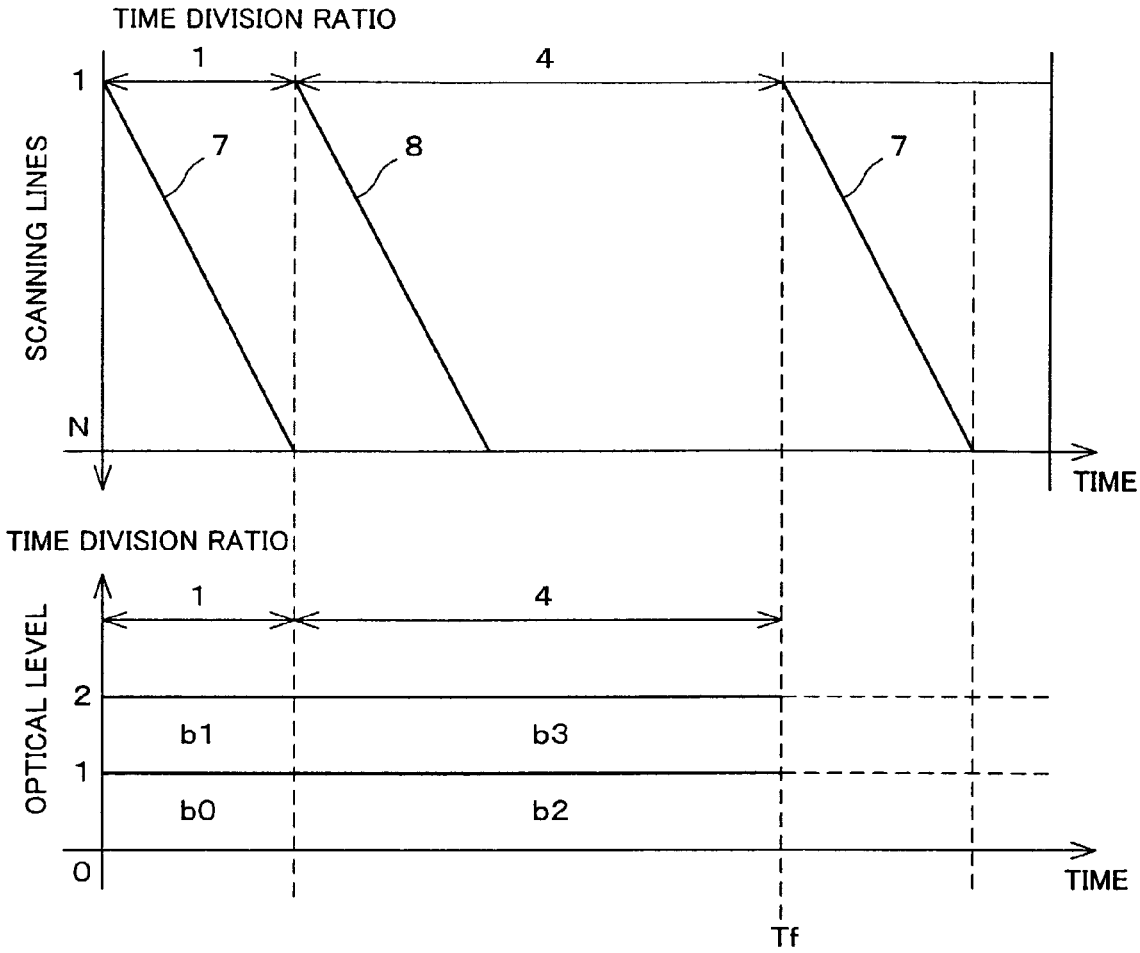
FIG. 2 is an explanatory view of scanning, indicating the driving when the display element of FIG. 1 carries out 4-bit gray scale driving using 2-bit gray scale pixels therein.

That is to say, when the scanning as illustrated in FIG. 2 is carried out for displaying moving images, etc. and then the scanning is discontinued after a particular field, the memory element 3 stores significant bits of the image information in the last scanning 9.

In this case, the capacity of the memory element 3 is 2 bits and the display is carried out with 4-bit gray scale, so that the memory element 3 stores first two bits b2 and b3.

Since the scanning is not carried out after this field, it is possible to keep the optical power at the gray scale level in accordance with the information bit stored in the memory element 3. Thus, as long as the optical power is kept, it is unnecessary to supply a new signal from an external driver so that the driver can be made inactive and the load of the driver and the power consumption of the display device can be reduced.

Figure 4:
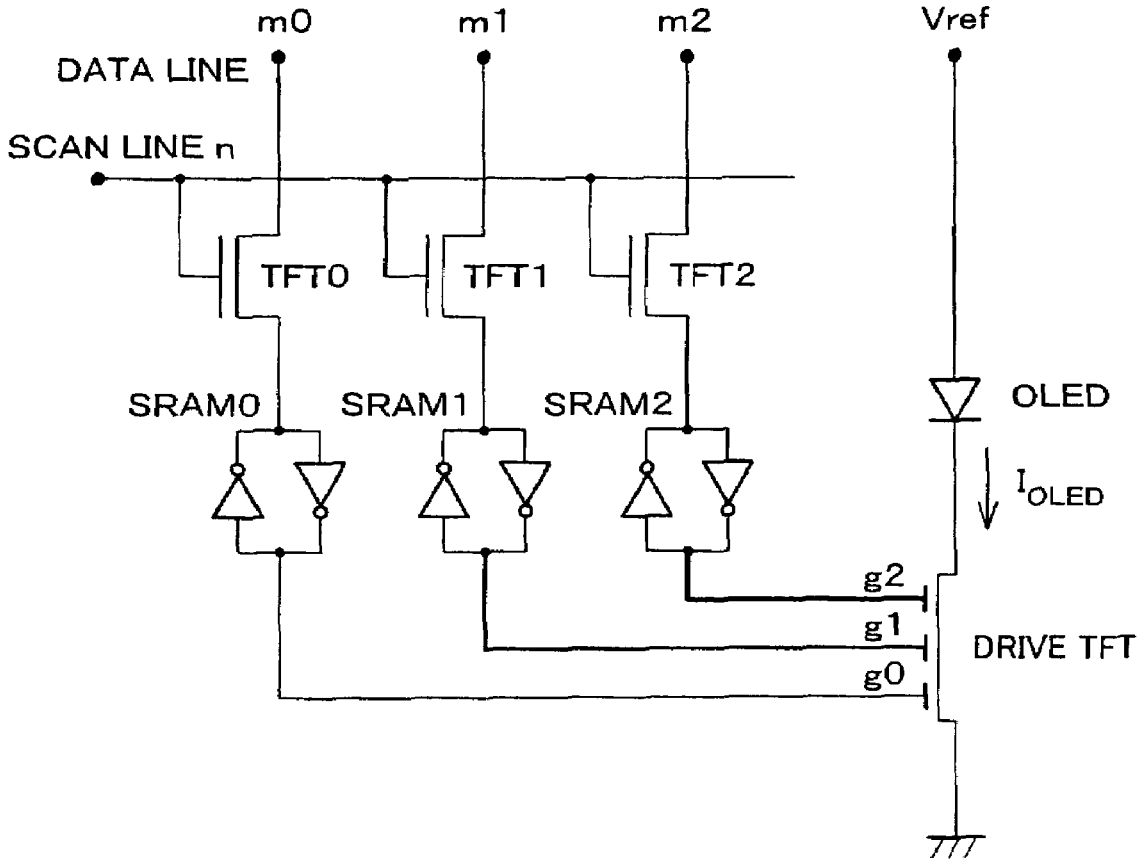
FIG. 4 is an explanatory view, showing an arrangement of a display element with memories, including 3-bit static memories.

As an example of the display element 1 illustrated in FIG. 1, the following description will discuss a display element which adopts, as FIG. 4 shows, an OLED (Organic Light Emission Diode) as an optical modulation element and a memory element 3 which is capable of storing 3-bit information by means of static memories SRAM 0, SRAM 1, and SRAM 2.

A drive TFT illustrated in FIG. 4 is arranged in such a manner that, when gate ends g0, g1, and g2 are selected respectively, the width and thickness of a gate electrode are adjusted to permit 8-level outputs $I_{OLED}$ corresponding to the selection, so that the electric conductivity is determined. In the case of normal display of moving images, when a scanning line n is selected, a 3-bit signal including the additional information of the corresponding sub field is supplied to data lines m0, m1, and m2 respectively, data is set in each of the static memories SRAM 0 through SRAM 2, and the sets of the data are outputted so that the display in accordance with these sets of the data is sustained until the scanning of the next sub field.

The electric conductivity between the source and drain of the drive TFT is determined in accordance with the state of the outputs of the respective SRAMs, and the gray scale display is carried out as a current corresponding to the electric conductivity runs through an OLED element.

In contrast, when the period between two scannings is long, first 3 bits of the image information are stored in the memory in the last scanning, and the stored image information is outputted so that the display in accordance with this image information is sustained. Since the display in this case is 8-level gray scale, when pixels of R, G, and B are adopted, the display with 512 colors can be realized.

That is to say, the signal supply from the driver, etc. is unnecessary when the display is kept in the state above. On this account, it is possible to reduce (i) the load of the driver for gray scale drive, which is provided in the display device, as well as (ii) the power consumption.

Figure 5:
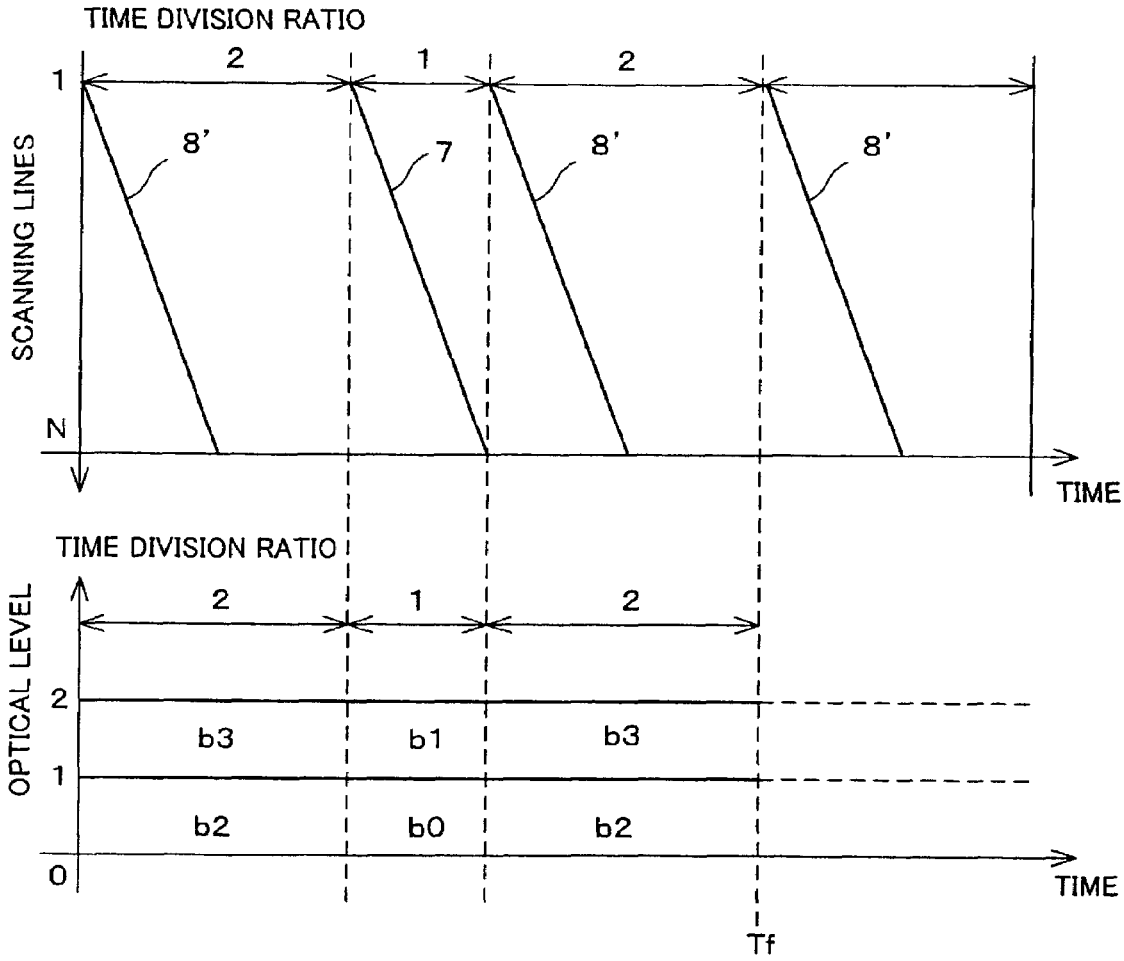
FIG. 5 is an explanatory view of scanning, indicating the case of 4-bit gray scale driving where a dynamic false contour is restrained thanks to the 2-bit gray scale pixels.

Moreover, while the display element 1 in accordance with the present embodiment adopts the arrangement illustrated in FIG. 1, the display element 1 also adopts, as FIG. 5 illustrates, a gray scale driving method in which the period whose time-division unit is 4 is further divided in two. Moreover, in the display element 1, an information bit is set twice in the memory element 3 during the field period, and the display element 1 is driven so as to carry out the display in accordance with this bit information. In this case, the temporal order of sub fields is arranged such that a sub field with a smaller time-division unit is sandwiched between sub fields with larger time-division units.

That is, in the display element carrying out the gray scale drive illustrated in FIG. 2, while the scanning 7 whose time-division unit is 1 starts at the beginning of the field, the scanning 8, whose time-division unit is 4 so as to be larger than the above, starts subsequently to the scanning 7. In contrast, a gray scale driving method illustrated in FIG. 5 is arranged in such a manner that a scanning 7, whose time-division unit is the smallest so as to be 1, is sandwiched between a scanning 8' and a scanning 8" which are the resultants of the division of the longest sub field.

As described above, the gray scale drive is carried out in such a manner that the longest field period, which has an effect to the occurrence of the dynamic false contour, is divided in two and the shortest field period is provided between the periods which are the resultants of the division of the longest sub field, so that the occurrence of the dynamic false contour can be restrained.

That is to say, when the display using a plurality of fields with the weight of the powers of 2 is carried out, usually the dynamic false contour occurs in accordance with the display pattern (lighting or non-lighting) of the field with the greatest weight. In other words, the dynamic false contour becomes visible owing to the synergistic effect of (i) the amount of travel of the luminous barycenter in the field period of a display field being maximized in the field period of the greatest weight and (ii) the luminous barycenter and the sight line of the viewer moving in accordance with the movement of images.

Thus, in the display element 1 in accordance with the present embodiment, the sub field with the greatest weight is divided in at least two, and the sub fields resulted from the division are provided in the first half and the second half of the whole field period, respectively. On this account, the luminous barycenter is kept more or less consistent regardless of the lighting condition of the field period of the greatest weight, so that the occurrence of the dynamic false contour can be effectively prevented.

Incidentally, in the case of the display using the field period with the weight of the powers of 2, in addition to the sub field with the greatest weight, the second and third heaviest fields are also divided in at least two, for preventing the variation of the luminous barycenter. On this account, the prevention of the occurrence of the dynamic false contour can be further ensured.

Now, the following descriptions will discuss that to what extent the occurrence of the dynamic false contour is reduced, comparing the display element adopting the time division gray scale driving method illustrated in FIG. 5 with the display element adopting the gray scale driving method illustrated in FIG. 2.

It is noted that in this case there are two domains in the screen: a domain A with 7-level (out of 0-15) gray scale and a domain B of 8-level (out of 0-15) gray scale, and the displayed image moves to the right, one pixel per field.

Figure 6:
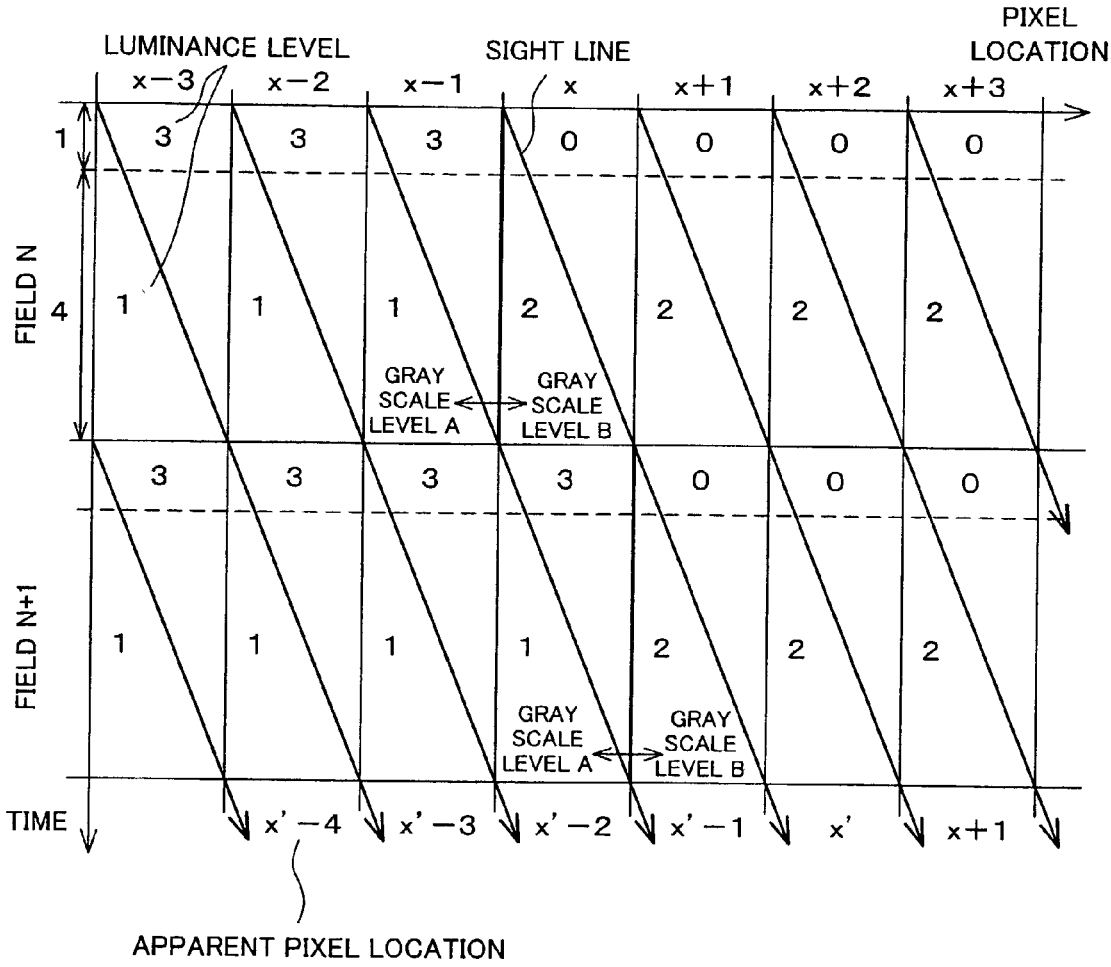
FIG. 6 is an explanatory view, illustrating the visibility process of the dynamic false contour when the display element of FIG. 1 adopts a time division display method.

The display element adopting the gray scale driving method illustrated FIG. 2 is arranged so that, as FIG. 6 shows, in a graph which includes a horizontal axis indicating a horizontal location x in a pixel line and a vertical axis indicating a time base, during a field period N, for instance, pixels to the left of a location x−1 display 7-level (out of 0-15) gray scale.

That is to say, in the sub fields at a division ratio of 1:4, the displays with the luminance levels of 3 and 1 are carried out, respectively.

Figure 7:
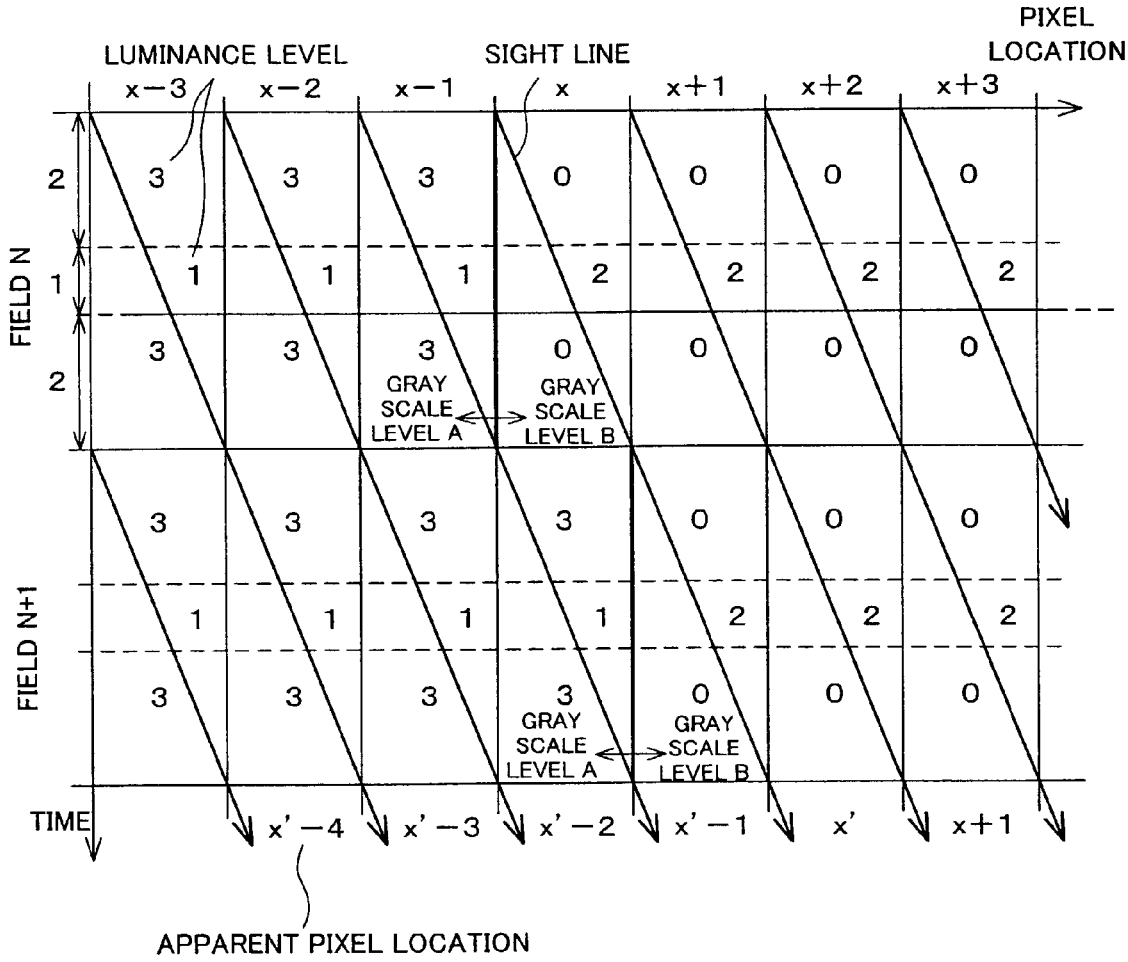
FIG. 7 is an explanatory view, illustrating the visibility process of the dynamic false contour when the display element of FIG. 1 adopts a time division display method which is different from the method illustrated in FIG. 6.

In contrast, the display element adopting the time division gray scale driving method illustrated in FIG. 5 is arranged so that, as FIG. 7 shows, sub fields are at a division ratio of 2:1:2, and in these fields, the displays with the luminance levels of 3, 1, and 3 are carried out, respectively.

In this manner, the luminance level of the dynamic false contour at the location x−1 is 7-level gray scale in total, in the whole field period.

In contrast, the display with 8-level gray scale is carried out at the neighboring pixel location x, and the luminance level in each of the sub fields is either 0 or 2.

Now, the following description will illustrate the dynamic false contour causing the degradation of the image quality in the above-identified time division display.

That is, in the display above, the displayed image moves to the right for one pixel in the field period N+1, and in the subsequent fields, the display image moves to the right, one pixel per field. In this case, when the viewer looks at the display screen, his/her sight line follows the border (indicated by thick solid lines in the figure) between the 7-level gray scale and the 8-level gray scale in the screen, so that he/she perceives the integration value of the display levels in the parallelogram, in the direction of hatched lines in the figure. Thus, around the border (x'−1), the apparent display perceived by the viewer is different from the actual display.

This is the principle of the occurrence of the dynamic false contour, so that in the case of adopting the time division display method, it is necessary to take account of the restraint of the dynamic false contour to prevent the degradation of the image quality.

Figure 8:
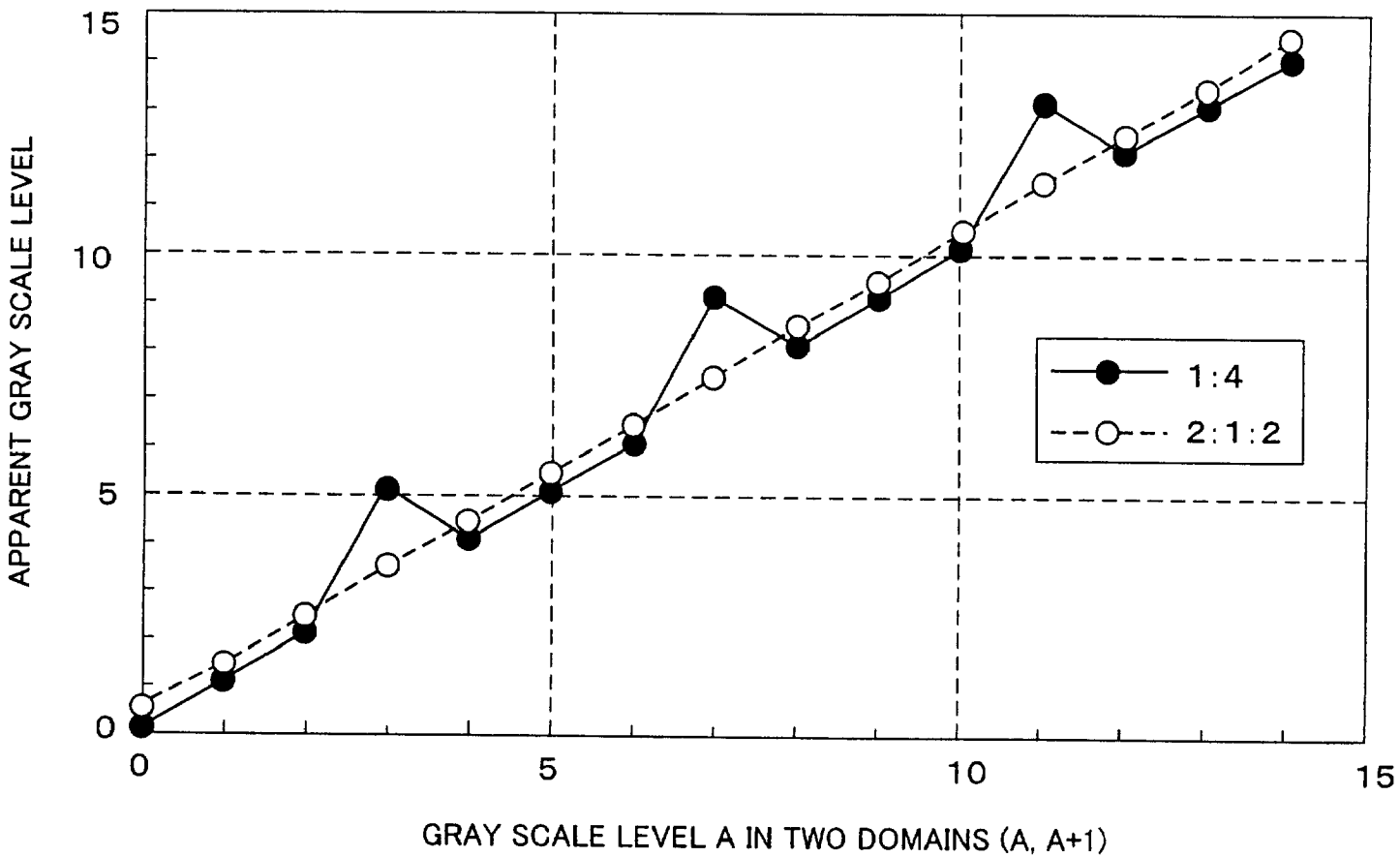
FIG. 8 is an explanatory view, showing an apparent gray scale level of the display element of FIGS. 6 and 7.

Provided that (i) the display element of FIG. 6 and the display element of FIG. 7 similarly carry out the display by scanning and (ii) in both of the display elements, the gray scale level A in one domain is different from the gray scale level B in the other domain by one gray scale level within 0-15 gray scale levels, i.e. B=A+1, FIG. 8 illustrates the luminance levels of the respective display elements with respective time-division units, which can be perceived at the location corresponding to the border between A and B, i.e. at the apparent location x'−1.

That is to say, referred to an average value of the input gray scale levels of A and B, which indicates an input reference luminance level, the maximum absolute value of the gray scale error acquired at the apparent location x'−1, which indicates a dynamic false contour gray scale error, is 1.6-level gray scale in the case of the time division period ratio of 1:4 or 0-level gray scale in the case of the time division period ratio of 2:1:2.

This indicates that, in the display element of the present embodiment illustrated in FIGS. 5 and 7, theoretically the dynamic false contour no longer occurs, when the longest sub field is divided in two. Thus, as illustrated in FIG. 5, when the time division gray scale driving method in which the longest sub field is divided in two and the resultant sub fields are provided in the first half and the second half of the whole field period respectively is adopted, it is possible to restrain the occurrence of the dynamic false contour and carry out excellent multi-level gray scale display.

Incidentally, it is possible to restrain the occurrence of the dynamic false contour in the example of the driving method of 4-bit gray scale display, and when the time division driving method is adopted in gray scale display using larger number of bits, it is possible to restrain the dynamic false contour to an acceptable level with which proper images can be acquired, for instance, to the level in which the gray scale error is not more than one gray scale level.

Figure 9:
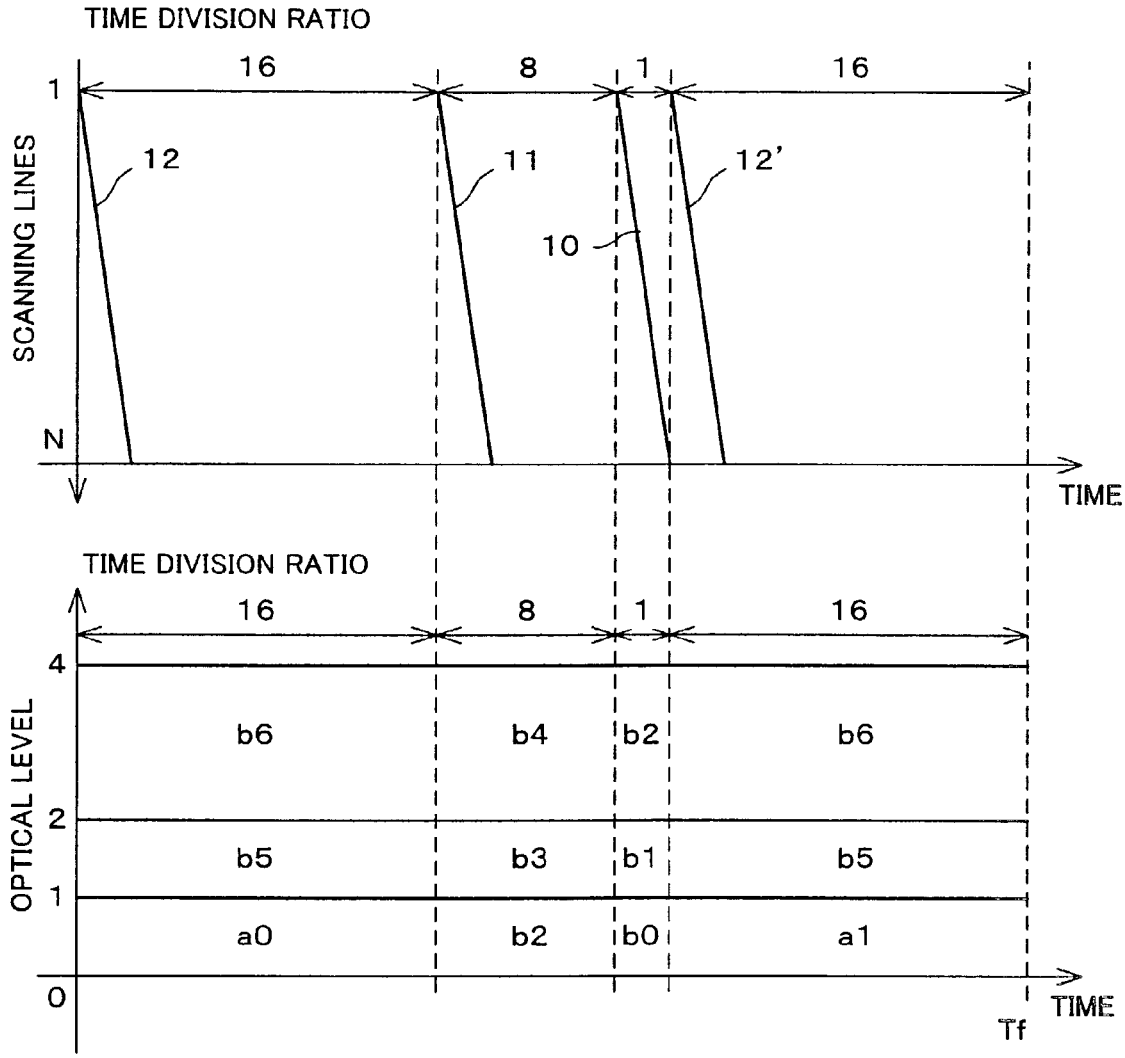
FIG. 9 is an explanatory view of scanning, indicating the driving when the display element of FIG. 1 carries out 6-bit gray scale driving.
Figure 10:
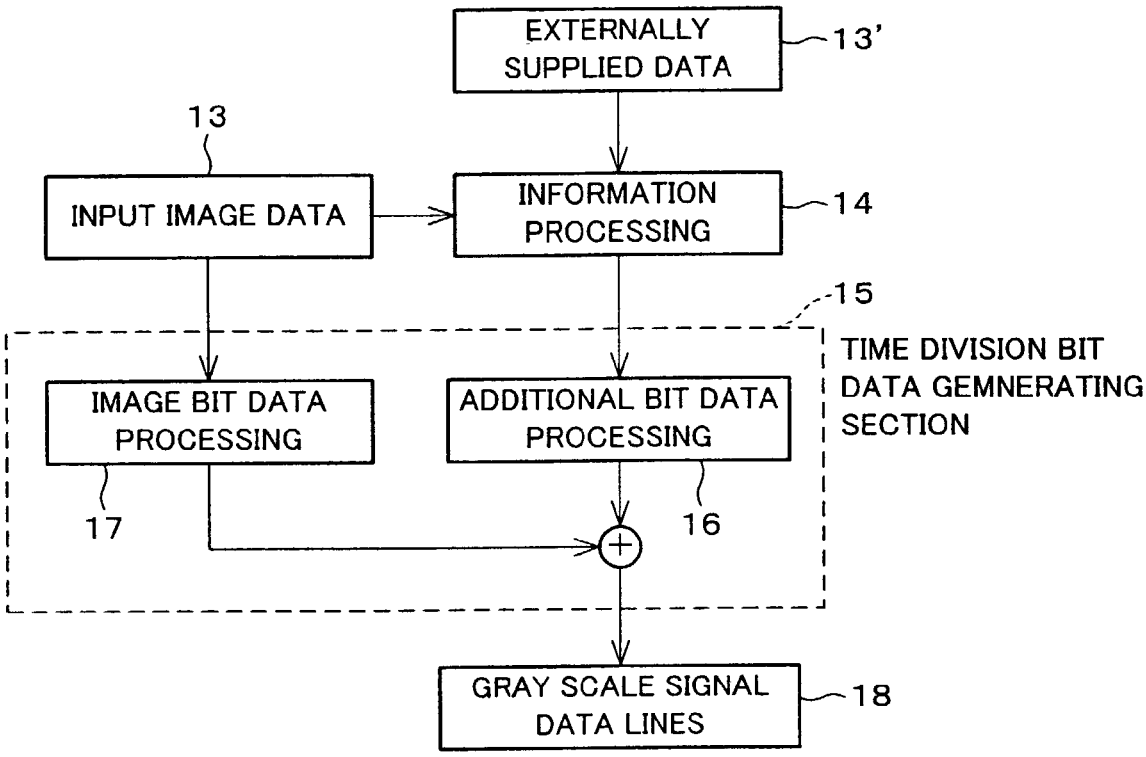
FIG. 10 is a conceptual diagram, indicating the process to add additional information bits to image information.

Now, referring to FIGS. 9 and 10, the following is descriptions of an example in which additional information bits are added to the image information of the display element arranged as above.

For instance, when 8-bit gray scale display is carried out, as illustrated in FIG. 9, arranging the time division period ratio of scannings 12, 11, 10, and 12' as 16:8:1:16 makes it possible to provide 2 additional information bits a0 and a1 in the scannings 12 and 12' respectively.

These additional information bits can be controlled together with the image information, and for instance, either a0 or a1 is displayed in accordance with the luminance level of the whole screen.

As FIG. 10 illustrates, the display element of the present invention is arranged so that in the process of adding the additional information bits to the image information, the data of the additional information bits is determined by the processing in a stage before the transfer of image data, using input image data 13, externally supplied data 13', information processing 14, a time division bit data generating section 15, and gray scale signal data lines 18.

By the way, the time division bit data generation section 15 carries out image bit data processing 17 and additional bit data processing 16.

In the display element in accordance with the present embodiment, the process of adding the information bits to the image information is carried out in such a manner that, as illustrated in FIG. 10, the input image data 13 or the externally supplied data 13' is processed in the information processing 14, and in accordance with the result of this processing, the output of the additional information bit data 16 in each pixel location is determined in the time division bit data generating section 15.

Incidentally, the processing in the information processing 14 may be carried out for determining the luminance level, for judging the level of tone of the screen, or for the correction of the edge, etc. of images.

In the image bit data processing 17, the output data at the time of converting the bit information of images at usual pixel locations to a time division manner is determined. The output of the time division bit data 15 is a signal of the combination of the image information bit data and the additional information bits, so as to be supplied to each of the gray scale signal data lines 18.

On this account, the addition of the additional information bits to the image information enables to display blight luminescent spots and accentuate the edge, when the displayed image is dark on the whole.

Thus, for instance, when 6-level gray scale display is carried out as in the gray scale driving method of the display element illustrated in FIG. 9, it is possible to provide 2 additional information bits.

Figure 11:
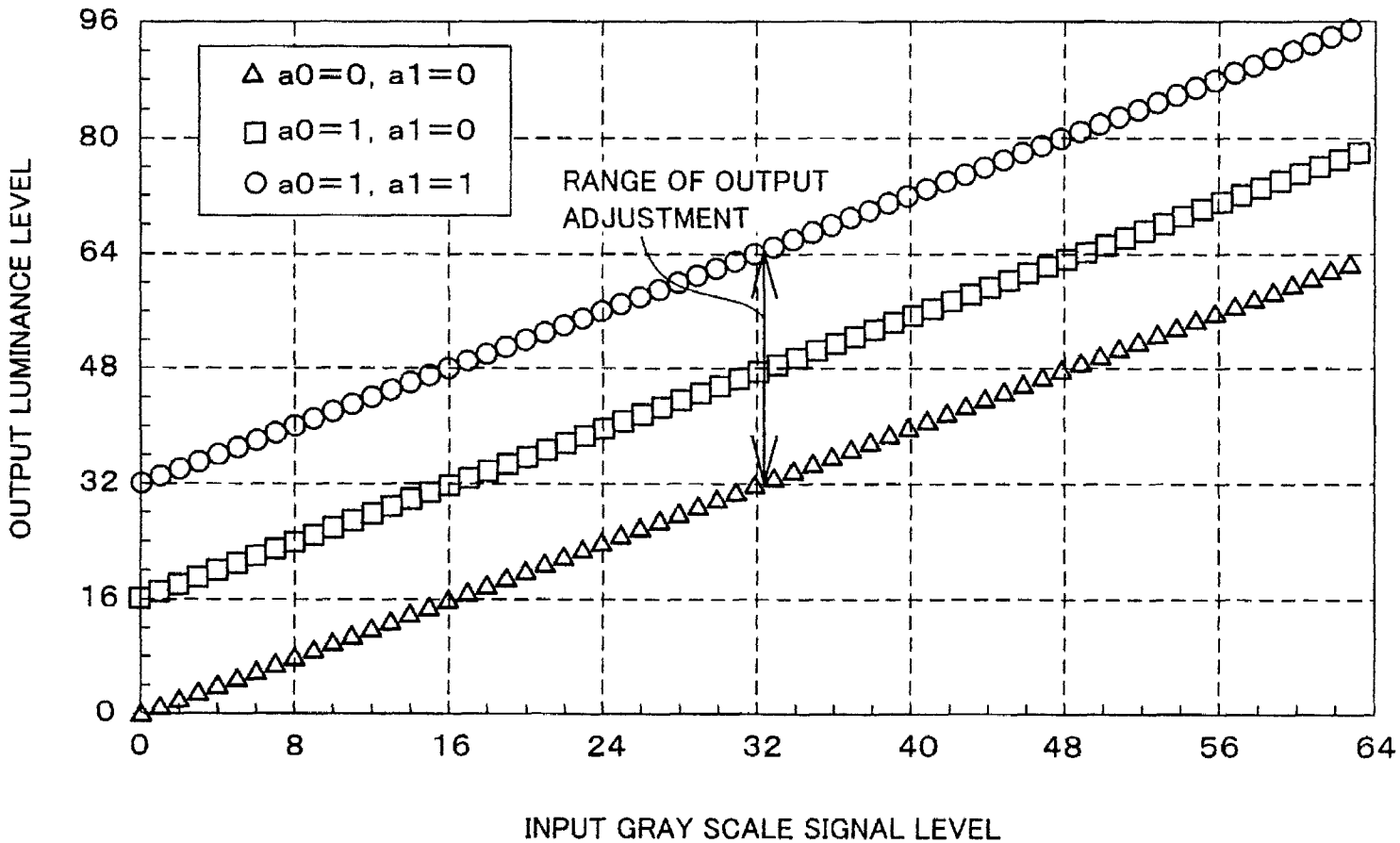
FIG. 11 is an explanatory view, illustrating the range of output adjustment by the additional information bits.

In the display element in accordance with the present embodiment, as illustrated in FIG. 11, since either of the additional information bits a0 and a1 is selected for the display, practically the offset in increments of 16-level gray scale can be carried out, and hence the displayed image can acquire 32-level gray scale at the maximum. In terms of the dynamic range, the luminance control can be done in the range of 63×1.5 gray scale levels.

Thus, when an average luminance level of the displayed image is low so that the displayed image gives dark impression on the whole, it is possible to adjust the gray scale level brighter by selecting the additional information bits and display a glittering image. Also, the additional information bits can be used for emphasizing the edges in the image and overlaying texts on the image.

Incidentally, as illustrated in FIG. 10, what is controlled by the additional information bits may be the processing of the input image data or the processing of the externally supplied data.

Moreover, in the display element in accordance with the present invention, provided that the number of all gray scale signal information bits is N, the number of memory bits is M, and the number of pixel selection in one field is K, it is possible to provide the additional information bits, where the number of bits F=M×K−N, to the image information.

That is to say, when the number of the memory bits is M, the display with $2^M$-level gray scale can be realized at the maximum during the sub field periods, and since K sub fields each having an appropriate weight are combined, the display with M×K-bit gray scale levels is practically carried out.

In this case, if the gray scale display where the weight is the power of 2 is carried out, the display with $2^{M\times K}$ gray scale levels at the maximum can be realized. However, to restrain the dynamic false contour, the sub field with the greatest weight is repeatedly divided in two so as to become as short as possible, and consequently the display with $2^N$(N>M×K) gray scale levels is realized.

For instance, when N=8 and M=3:

First Sub Field: 64, Display Gray Scale Level: 64, 128, 256

Second Sub Field: 1, Display Gray Scale Level: 1, 2,

Third Sub Field: 8, Display Gray Scale Level: 8, 16, 32

In this case, K=3 and the number of the gray scale levels is $2^9$ so that the redundancy is greater compared with the case of the display with $2^8$ gray scale levels, and since the sub field with the greatest weight is long, strong dynamic false contour occurs.

So, as described below, the first sub field is divided in two so that a fourth sub field is provided.

First Sub Field: 16, Display Gray Scale Level: 16, 32, 64

Second Sub Field: 1, Display Gray Scale Level: 1, 2, 4

Third Sub Field: 8, Display Gray Scale Level: 8, 16, 32

Fourth Sub Field: 16, Display Gray Scale Level: 16, 32, 64

In this case K=4, and when the first and fourth sub fields adopt the same signal, the displays with 64-level and 128-level gray scale, which are first two bits within 256 gray scale levels, are carried out at 32-level gray scale and 64-level gray scale of the respective fields. Also, 16-level gray scale, which can be displayed in the same sub field, is capable of being set as image display bits independent from the overall gray scale display, so as to be able to carry out the displays with 0-level gray scale and 32-level gray scale by 1 bit.

When the additional information bits of the first and fourth sub fields respectively are independently controlled, it is possible to carry out 3 types of displays with 0-level gray scale, 16-level gray scale, and 32-level gray scale, by 2 bits.

When 6-bit gray scale display is carried out in a similar manner, it is not possible to provide additional information bits even when M=2 or 3. However, redundancy is provided when M>3, and this makes it possible to provide the additional information bits.

As described above, the additional information bits which meet F=M×K−N are added to the image information so that within the range of signal electrode lines required for storing gray scale signal data, for instance, it is possible to supply the output with display luminance modified in accordance with the display condition of an image with such as an average luminance level.

The restraint of the dynamic false contour using the display element arranged as above will be specifically described below, referring to Tables 1 through 4.

The display element described here is arranged such that the memory element 3 described in FIG. 1 can store 3-bit (2-bit) information and 3-bit (2-bit) gray scale display can be carried out in the block 6.

Table 1 indicates the time division ratio and the absolute value of the gray scale error in this display element, when the number of gray scale display bits is N. In this case, the longest sub field is divided in two and the resultant sub fields sandwich a sub field shorter than these two, as in the time division gray scale driving method indicated in FIG. 5.

TABLE 1

| GRAY SCALE BITS (NUMBER OF MEMORY BITS) | NUMBER OF GRAY SCALE LEVELS | TIME DIVISION RATIO (CORRESPONDING BITS) | PIXEL 1: ONLY m-TH BIT FROM THE TOP BIT IS TURNED ON PIXEL 2: ONLY TOP BIT TO m-1TH BIT ARE TURNED ON | | | | | | | | | | | |
|---|---|---|---|---|---|---|---|---|---|---|---|---|---|---|
| | | | m = 1 | m = 2 | m = 3 | m = 4 | m = 5 | m = 6 | m = 7 | m = 8 | m = 9 | m = 10 | m = 11 | m = 12 |
| 12(3) | 4096 | 256(b9,b10,b11):64(b6,b7,b8): 8(b3,b4,b5):1(b0,b1,b2): 256(b9,b10,b11) | 0.00 | 0.00 | 0.00 | 3.94 | 3.94 | 3.94 | 0.00 | 0.00 | 0.00 | 0.06 | 0.06 | 0.06 |
| 11(3) | 2048 | 128(a0,b9,b10):64(b6,b7,b8): 8(b3,b4,b5):1(b0,b1,b2): 128(a1,b9,b10) | 0.00 | 0.00 | 7.00 | 7.00 | 7.00 | 0.00 | 0.00 | 0.00 | 0.11 | 0.11 | 0.11 | — |
| 10(3) | 1024 | 64(a0,a1,b9):64(b6,b7,b8): 8(b3,b4,b5):1(b0,b1,b2): 64(a2,a3,b9) | 0.00 | 11.46 | 11.46 | 11.46 | 0.00 | 0.00 | 0.00 | 0.18 | 0.18 | 0.18 | — | — |
| 9(3) | 512 | 32(b6,b7,b8):8(b3,b4,b5): 1(b0,b1,b2):32(b6,b7,b8) | 0.00 | 0.00 | 0.00 | 0.44 | 0.44 | 0.44 | 0.05 | 0.05 | 0.15 | — | — | — |
| 8(3) | 256 | 16(a0,b6,b7):8(b3,b4,b5): 1(b0,b1,b2):16(a1,b6,b7) | 0.00 | 0.00 | 0.78 | 0.78 | 0.78 | 0.10 | 0.10 | 0.10 | — | — | — | — |
| 7(3) | 128 | 8(a0,a1,b6):8(b3,b4,b5): 1(b0,b1,b2):8(a2,a3,b6) | 0.00 | 1.28 | 1.28 | 1.28 | 0.16 | 0.16 | 0.16 | — | — | — | — | — |
| 6(3) | 64 | 4(b3,b4,b5):1(b0,b1,b2):4(b3,b4,b5) | 0.00 | 0.00 | 0.00 | 0.00 | 0.00 | 0.00 | — | — | — | — | — | — |
| 8(2) | 256 | 32(b6,b7):16(b4,b5):4(b2,b3): 1(b0,b1):32(b6,b7) | 0.00 | 0.00 | 1.88 | 1.88 | 0.00 | 0.00 | 0.12 | 0.12 | — | — | — | — |
| 6(2) | 64 | 8(b4,b5):4(b2,b3):1(b0,b1):8(b4,b5) | 0.00 | 0.00 | 0.38 | 0.38 | 0.10 | 0.10 | — | — | — | — | — | — |

Incidentally, N(M) in Table 1 indicates that the number of memory bits, when N gray scale bits are adopted, is M.

Image information bit numbers $b_n$ and additional information bit numbers $a_n$ corresponding to the respective sub fields are illustrated along with the respective time-division units. Also, as a gray scale signal pattern for figuring out the gray scale error, illustrated in FIG. 1, a pattern in which the display condition of sub fields with heavy weight is switched between two gray scale domains is adopted.

In Table 1, when only m-th bit from the most significant bit is turned on in a pixel 1 and bits not more than (m−1)-th bit are all turned on in a pixel 2, 12-bit gray scale (N=12) is realized, and if m=1 in addition to the above, the pixel 1 carries out the display with 2048-level (out of 4096) gray scale and the pixel 2 carries out the display with 2047-level gray scale.

If m=2, the pixel 1 carries out the display with 1024-level gray scale and the pixel 2 carries out the display with 1023-level gray scale. That is to say, the difference of the gray scale level between the pixels 1 and 2 is 1, and the gray scale levels at which bit transition occurs at a great level are compared with each other.

with this number, the number of the sub fields increases so as to be more than the number of the sub fields in the case of adopting 3-bit memories. In this case, the gray scale error is not more than one gray scale level in the 6-bit gray scale display, so that the dynamic false contour is restrained so as to be ignorable. Since the gray scale error is 2 gray scale levels at the maximum in the 8-bit gray scale display, the dynamic false contour is not ignorable. However, this problem can be solved by adopting the memories capable of storing 3 bits.

Moreover, in this case, it is obvious that the dynamic false contour can be dramatically restrained, compared with the case in which the occurrence of the dynamic false contour is set aside.

That is to say, in an element arranged in such a manner that the memory element 3 can store 3-bit (or 2-bit) information and 3-bit (2-bit) gray scale display can be carried out in the block 6 as illustrated in FIG. 1, the absolute value of the gray scale error of the display element, in which the longest sub field is not divided when the number of gray scale display bits is N, is described in Table 2.

TABLE 2

| GRAY SCALE BITS (NUMBER OF MEMORY BITS) | NUMBER OF GRAY SCALE LEVELS | TIME DIVISION RATIO (CORRESPONDING BITS) | PIXEL 1: ONLY m-TH BIT FROM THE TOP BIT IS TURNED ON PIXEL 2: ONLY TOP BIT TO m-1TH BIT ARE TURNED ON | | | | | | | | | | | |
|---|---|---|---|---|---|---|---|---|---|---|---|---|---|---|
| | | | m = 1 | m = 2 | m = 3 | m = 4 | m = 5 | m = 6 | m = 7 | m = 8 | m = 9 | m = 10 | m = 11 | m = 12 |
| 12(3) | 4096 | 512(b9,b10,b11):64(b6,b7,b8):8(b3,b4,b5):1(b0,b1,b2) | 255.6 | 255.6 | 255.6 | 3.50 | 3.50 | 3.50 | 0.44 | 0.44 | 0.44 | 0.50 | 0.50 | 0.50 |
| 11(3) | 2048 | 256(a0,b9,b10):64(b6,b7,b8):8(b3,b4,b5):1(b0,b1,b2) | 255.6 | 255.6 | 6.61 | 6.61 | 6.61 | 0.39 | 0.39 | 0.39 | 0.50 | 0.50 | 0.50 | — |
| 10(3) | 1024 | 128(a0,a1,b9):64(b6,b7,b8):8(b3,b4,b5):1(b0,b1,b2) | 255.7 | 11.14 | 11.14 | 11.14 | 0.32 | 0.32 | 0.32 | 0.50 | 0.50 | 0.50 | — | — |
| 9(3) | 512 | 64(b6,b7,b8):8(b3,b4,b5):1(b0,b1,b2) | 31.56 | 31.56 | 31.56 | 0.00 | 0.00 | 0.00 | 0.49 | 0.49 | 0.49 | — | — | — |
| 8(3) | 256 | 32(a0,b6,b7):8(b3,b4,b5):1(b0,b1,b2) | 31.61 | 31.61 | 0.39 | 0.39 | 0.39 | 0.49 | 0.49 | 0.49 | — | — | — | — |
| 7(3) | 128 | 16(a0,a1,b6):8(b3,b4,b5):1(b0,b1,b2) | 31.68 | 0.96 | 0.96 | 0.96 | 0.48 | 0.48 | 0.48 | — | — | — | — | — |
| 6(3) | 64 | 8(b3,b4,b5):1(b0,b1,b2) | 3.56 | 3.56 | 3.56 | 0.44 | 0.44 | 0.44 | — | — | — | — | — | — |
| 8(2) | 256 | 64(b6,b7):16(b4,b5):4(b2,b3):1(b0,b1) | 31.62 | 31.62 | 1.51 | 1.51 | 0.38 | 0.38 | 0.49 | 0.49 | — | — | — | — |
| 6(2) | 64 | 16(b4,b5):4(b2,b3):1(b0,b1) | 7.62 | 7.62 | 0.00 | 0.00 | 0.48 | 0.48 | — | — | — | — | — | — |

Table 1 also shows the gray scale error between (i) a time division pattern in which the memories can store 3 bits and the number of the gray scale bits N is between 12 and 6, and (ii) a time division pattern in which the memories can store 2 bits and the number of the gray scale bits N is between 8 and 6.

The gray scale error is figured out using the method described with reference to FIGS. 6 and 7, and in Table 1, when the memories can store 3 bits and the number of the gray scale bits is 9, 8, or 6, the gray scale error can be retrained below one gray scale level.

In the case of 7-bit gray scale display, since the gray scale error is not less than one gray scale level, the gray scale inversion could occur. However, this cause no problems if the rate of occurrence of the gray scale inversion is below a tolerable rate.

Similarly, in the case of the arrangement using the memories capable of storing 2 bits, the number of the bits of the gray scale levels of the pixel itself is 2, and hence in accordance As Table 2 indicates, in all time-division methods, since the gray scale error is not less than 1 gray scale level in all gray scale bit transitions, it is obvious that the dynamic false contour occurs so that the display is not properly carried out.

However, as described above, the dynamic false contour is restrained if pixels are converted to multiple gray scale pixels by providing memory bits therein, compared with an arrangement of a display element without memories, which is illustrated below.

In an element arranged in such a manner that the memory element 3 can store 1-bit information and the binary gray scale display can be carried out in the block 6, the absolute value of the gray scale error of the display element, in which the longest sub field is not divided when the number of gray scale display bits is N, and the absolute value of the gray scale error of the display element, in which only the longest sub field is divided in two, are described in Tables 3 and 4 respectively.

TABLE 3

| GRAY SCALE BITS | NUMBER OF GRAY SCALE LEVELS | TIME DIVISION RATIO (CORRESPONDING BITS) | PIXEL 1: ONLY m-TH BIT FROM THE TOP BIT IS TURNED ON PIXEL 2: ONLY TOP BIT TO m-1TH BIT ARE TURNED ON m = 1 | m = 2 | m = 3 | m = 4 | m = 5 | m = 6 | m = 7 | m = 8 |
|---|---|---|---|---|---|---|---|---|---|---|
| 8 | 256 | 128(b7):64(b6):32(b5):16(b4):8(b3):4(b2):2(b1):1(b0) | 63.75 | 15.56 | 3.51 | 0.50 | 0.25 | 0.44 | 0.49 | 0.50 |
| 7 | 128 | 64(b6):32(b5):16(b4):8(b3):4(b2):2(b1):1(b0) | 31.75 | 7.56 | 1.51 | 0.00 | 0.38 | 0.47 | 0.50 | — |
| 6 | 64 | 32(b5):16(b4):8(b3):4(b2):2(b1):1(b0) | 15.75 | 3.56 | 0.51 | 0.25 | 0.44 | 0.49 | — | — |
| 5 | 32 | 16(b4):8(b3):4(b2):2(b1):1(b0) | 7.74 | 1.55 | 0.00 | 0.39 | 0.48 | — | — | — |
| 4 | 16 | 8(b3):4(b2):2(b1):1(b0) | 3.73 | 0.53 | 0.27 | 0.47 | — | — | — | — |
| 3 | 8 | 4(b2):2(b1):1(b0) | 1.71 | 0.00 | 0.43 | — | — | — | — | — |

TABLE 4

| GRAY SCALE BITS | NUMBER OF GRAY SCALE LEVELS | TIME DIVISION RATIO (CORRESPONDING BITS) | PIXEL 1: ONLY m-TH BIT FROM THE TOP BIT IS TURNED ON PIXEL 2: ONLY TOP BIT TO m-1TH BIT ARE TURNED ON m = 1 | m = 2 | m = 3 | m = 4 | m = 5 | m = 6 | m = 7 | m = 8 |
|---|---|---|---|---|---|---|---|---|---|---|
| 8 | 256 | 64(b7):64(b6):32(b5):16(b4):8(b3):4(b2):2(b1):1(b0):64(b7) | 0.00 | 15.81 | 3.76 | 0.75 | 0.00 | 0.19 | 0.24 | 0.25 |
| 7 | 128 | 32(b6):32(b5):16(b4):8(b3):4(b2):2(b1):1(b0):32(b6) | 0.00 | 7.81 | 1.76 | 0.25 | 0.13 | 0.22 | 0.24 | — |
| 6 | 64 | 16(b5):16(b4):8(b3):4(b2)2(b1):1(b0):16(b5) | 0.00 | 3.81 | 0.76 | 0.00 | 0.19 | 0.24 | — | — |
| 5 | 32 | 8(b4):8(b3):4(b2):2(b1)1(b0):8(b4) | 0.00 | 1.81 | 0.26 | 0.13 | 0.23 | — | — | — |
| 4 | 16 | 4(b3):4(b2):2(b1):1(b0):4(b3) | 0.00 | 0.80 | 0.00 | 0.20 | — | — | — | — |
| 3 | 8 | 2(b2):2(b1):1(b0):2(b2) | 0.00 | 0.29 | 0.14 | — | — | — | — | — |

Table 3 shows that in the display element in which the longest sub field is not divided in two, the gray scale error, which is around 25% of the maximum gray scale levels, is generated due to the transition of the greatest gray scale bit.

Also, in the display element in which only the longest sub field is divided in two, as Table 4 illustrates, only the gray scale error caused by the transition of the greatest gray scale bit is restrained, while the gray scale error caused by the transition of lower gray scale bits is rarely adjusted.

As described above, by dividing the longest sub field in two, it is possible to reduce the gray scale error and restrain the occurrence of the dynamic false contour, when the gray scale display with a small number of bits is carried out. when the gray scale display with a great number of bits is carried out, not only the longest sub field but also other sub fields are divided in two so that the gray scale error caused by the transitions of the smaller gray scale bits can also be restrained and the restraint of the occurrence of the dynamic false contour is further ensured.

In the display element in accordance with the present embodiment, thanks to the arrangement illustrated above, it is possible to restrain the occurrence of the dynamic false contour and acquire the display element in which the load of the driver is restrained, by controlling the number of time division, the time division ratio, and the number of memory bits, and carrying out more various types of setup of the output of the gray scale display.

Embodiment 2

The following description will discuss another embodiment in accordance with the present invention, in reference to FIGS. 12 through 17.

By the way, members having the same functions as those described in Embodiment 1 with figures are given the same numbers, so that the descriptions are omitted for the sake of convenience.

Figure 12:
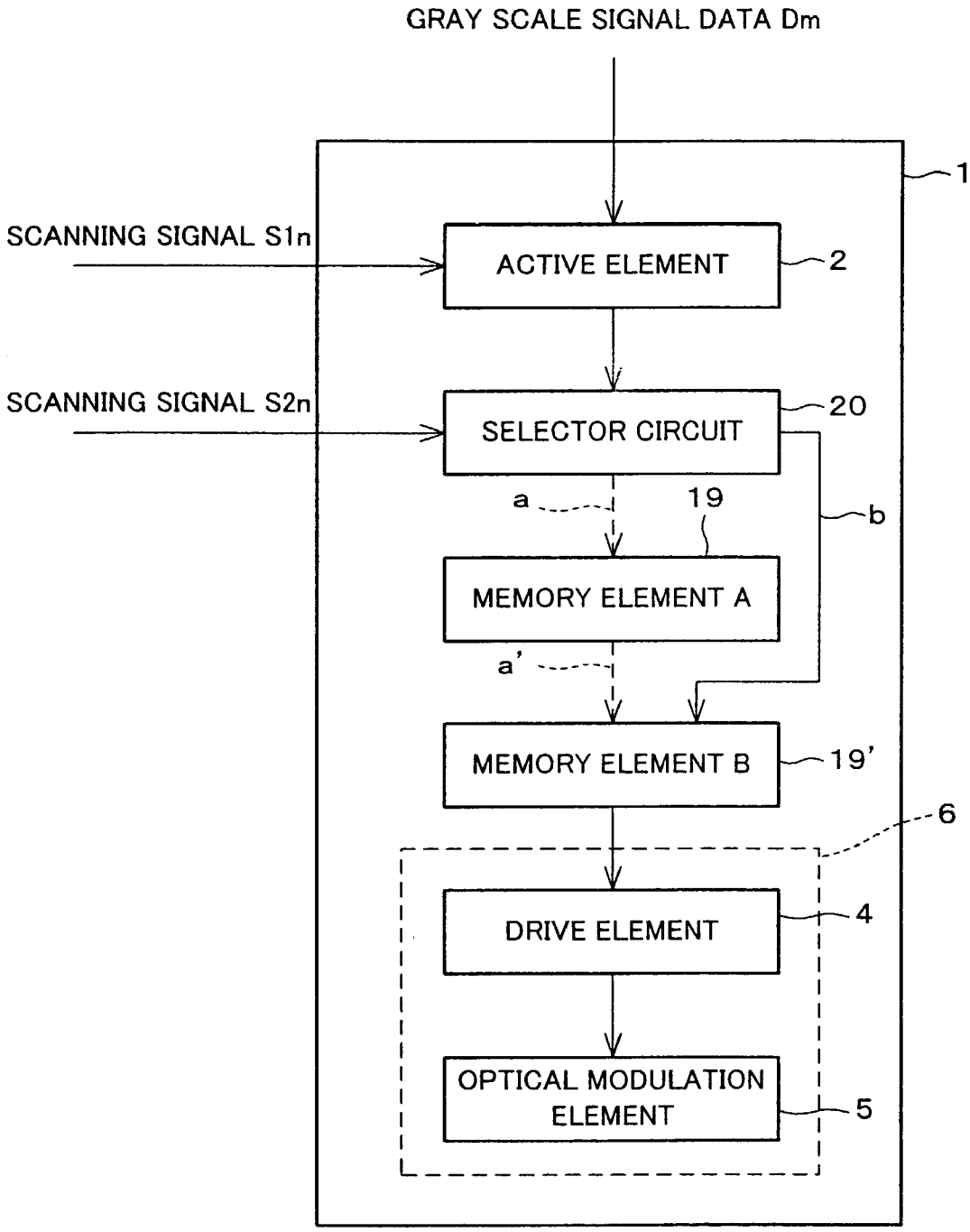
FIG. 12 is a conceptual diagram, indicating signal paths in a display element in accordance with another embodiment of the present invention.

As FIG. 12 illustrates, a display element 1' in accordance with the present embodiment is provided at coordinates (n, m) in the screen, and includes an active element 2, a selector circuit 20, a memory element A (first storage means) 19, a memory element B (second storage means) 19', and a block 6, in a matrix. Also, two scanning signals S1*n* and S2*n* are supplied to the active element 2 and the selector circuit 20, respectively. The block 6 is provided with a drive element 4 and an optical modulation element 5.

Gray scale signal data Dm supplied to the active element 2 is outputted via a path a by the selector circuit 20 so as to be stored in the memory element A19, when the scanning signal S1*n* also supplied to the active element 2 and the scanning signal S2*n* are both selected. Then the gray scale signal data Dm stored in the memory element A19 is supplied to the memory element B19' from the memory element A19 via the path a, so as to be kept in the memory element B19'.

In the meantime, when the scanning signal S1*n* is selected while the scanning signal S2*n* is not selected, the selector circuit 20 outputs the gray scale signal data Dm via a path b, and the memory element B19' stores the same.

Thanks to the arrangement above, the display element 1' in accordance with the present embodiment can obtain the optical power in accordance with the gray scale signal data Dm from the optical modulation element 5, by sending the gray scale signal data Dm stored in the memory element B19' to the drive element 4.

Also, provided that the scanning signal S1*n* is selected while the scanning signal S2*n* is not selected and then the scanning signal S1*n* becomes non-selection state after the gray scale signal data Dm is stored in the memory element B19', the state of the scanning signal S2*n* varies from non-selection to selection. On this account, the gray scale signal data Dm kept in the memory element B19' is replaced by gray scale signal data kept in the memory element A19, which is supplied via a path a'. Thus, as in the arrangement above, the optical power in accordance with the gray scale signal data Dm can be obtained from the optical modulation element 5, by sending the gray scale signal data Dm stored in the memory element B19' to the drive element 4.

Incidentally, the memory element A19 is preferably a memory which is nonvolatile and capable of storing data for a long time. Also, the memory element B19' is a memory which can store data during at least a sub field period, and may be a volatile memory using a capacitor, etc. or a nonvolatile memory.

Now, the following description will discuss a method of conducting 4-bit gray scaly drive display when the memory element A19 is a memory capable of storing 1 bit.

When a period Ts required for scanning all lines (hereinafter, will be simply referred to as scanning period Ts) is equal to a period corresponding to the time-division unit 1 of the sub field of the least significant bit, as FIG. 13 indicates, sub field periods of respective bits bn are arranged as:

b3:b2:b1:b0:b3=4:4:2:1:4

In this case, in one field period Tf, a first scanning 21 is arranged such that the scanning signals S1*n* and S2*n* in FIG. 12 are both selected, and the gray scale signal data Dm is kept in the memory element A19 and the memory element B19' so that the display is carried out. During subsequent scannings 22 through 24, since the scanning signal S2*n* is not selected, the signal is written in the memory element B19' without passing through the memory element A19 so that the display is carried out. At this stage, sets of data b3 through b0 are all supplied from the outside. However, in a scanning 21', the display is carried out with the data b3 from the memory element 19' for the second time, without re-receiving the data b3 from the outside.

Here, the scanning signal S1*n* illustrated in FIG. 12 is not selected, the scanning signal S2*n* is selected, and the data stored in the memory element A19 is supplied to the memory element B19' so that the display is carried out.

Regarding the order of inputting the data bits, since the display has to be carried out in the time division manner during the period corresponding to the first bit which has the greatest effect on the occurrence of the dynamic false contour, it is required that the significant bits are inputted first and stored in the memory element A19. Also, since the sub field corresponding to b3 is divided at a ratio of 4:4 so that the resultant sub fields have the same lengths, the dynamic false contour can be restrained in the most effective manner.

Figure 13:
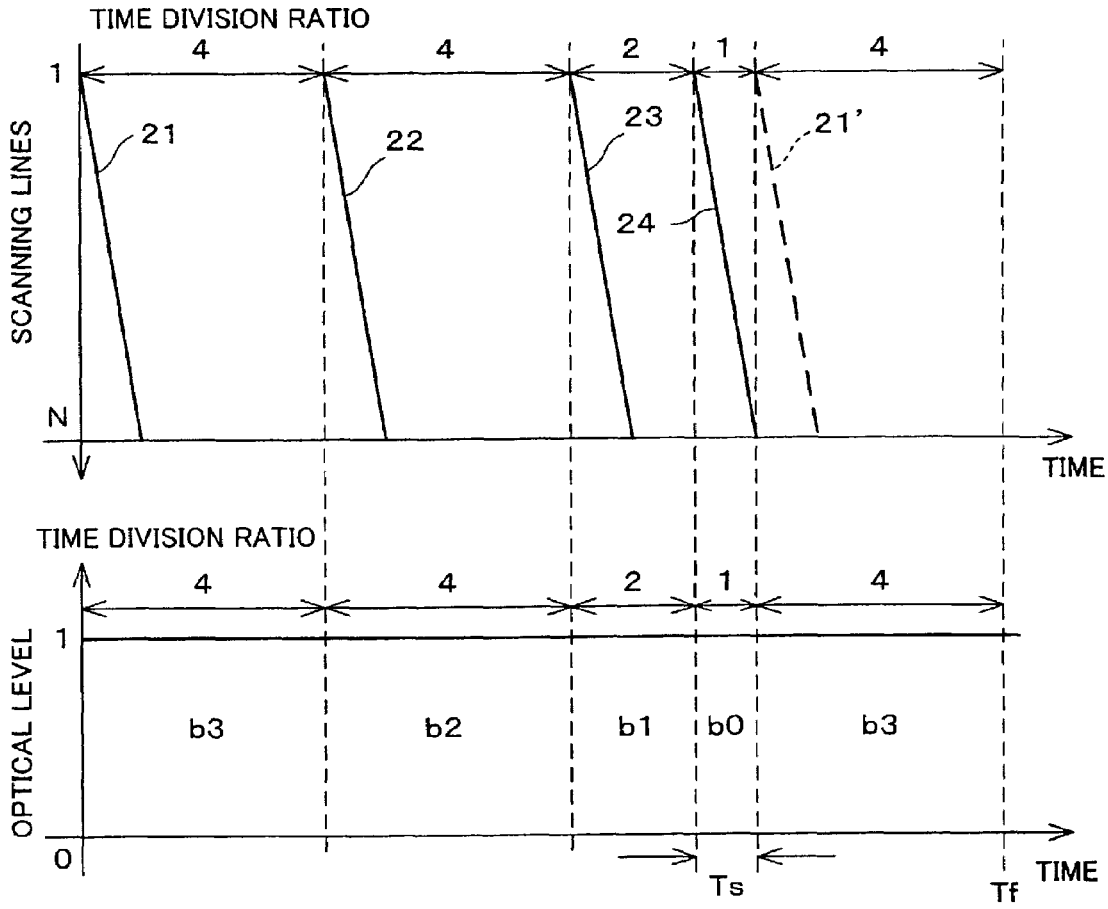
FIG. 13 is an explanatory view of scanning, indicating the driving when the display element of FIG. 12 carries out 4-bit time division gray scale driving using memories for significant bits.
Figure 14:
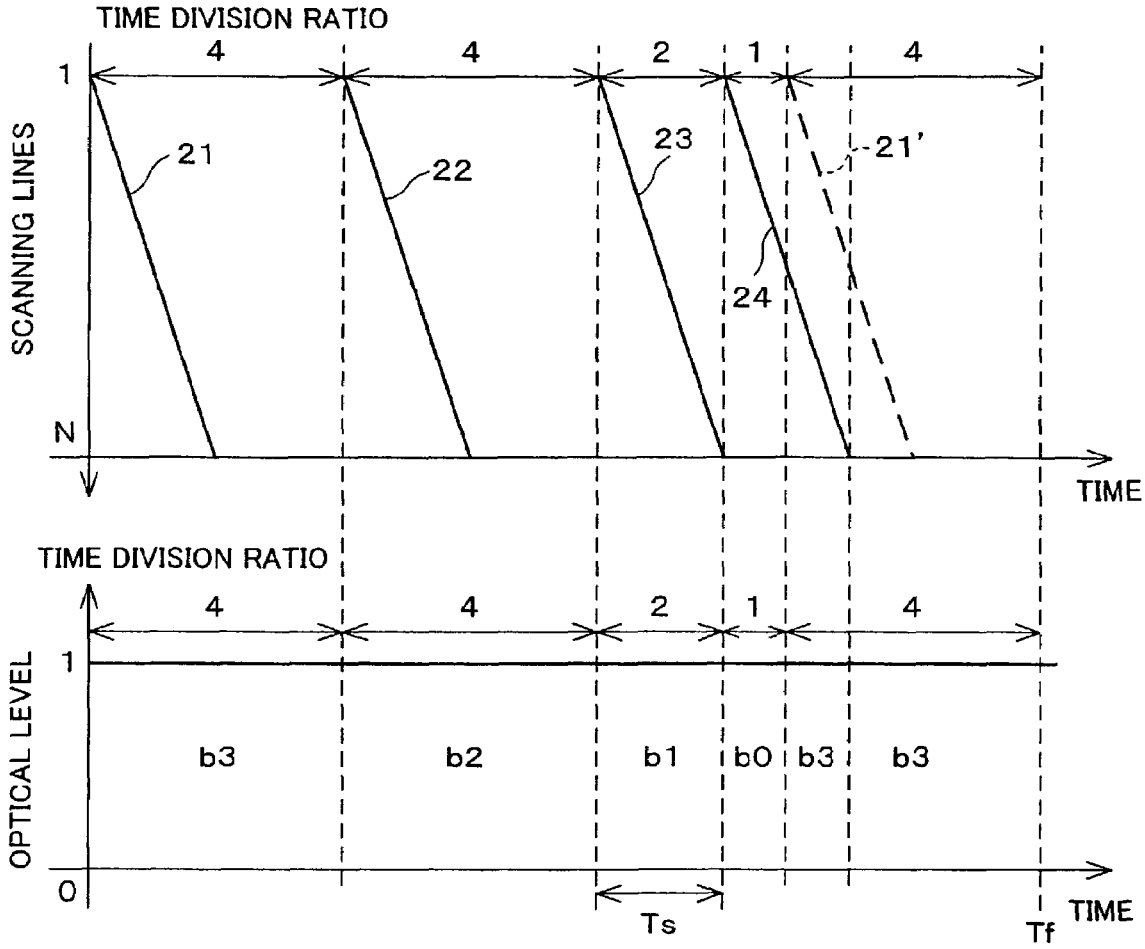
FIG. 14 is an explanatory view of scanning, indicating that the display element of FIG. 12 carries out 4-bit time division gray scale driving, when the scanning time is different from that of the driving in FIG. 13.

FIG. 14 indicates a gray scale driving method of the display element in which the length of the scanning period Ts is arranged so as to be twice as much as the length of the sub field of the least significant bit. As in the case illustrated in FIG. 13, the sub field periods of the respective bits bn can be arranged as:

b3:b2:b1:b0:b3=4:4:2:1:4

While the scanning 21' starts after the scanning 24 is finished with respect to all lines in the case of FIG. 13, in the case illustrated in FIG. 14, the scanning 21' starts before the scanning 24 finishes with respect to all lines. In other words, the case if FIG. 13 is different from the case of FIG. 14 in the timing of the start of the scanning 21'.

Since the scanning signals S1*n* and S2*n* illustrated in FIG. 12 can carry out scanning independently, as FIG. 14 indicates, it is possible to elongate the scanning period Ts and the selection period per each line.

As a result, it is possible to (i) create the margin of time at the time of transferring data and (ii) severely restrain the drive frequency, and hence the load and the power consumption of the driver can be further reduced, compared with the display element 1 in accordance with Embodiment 1.

Figure 15:
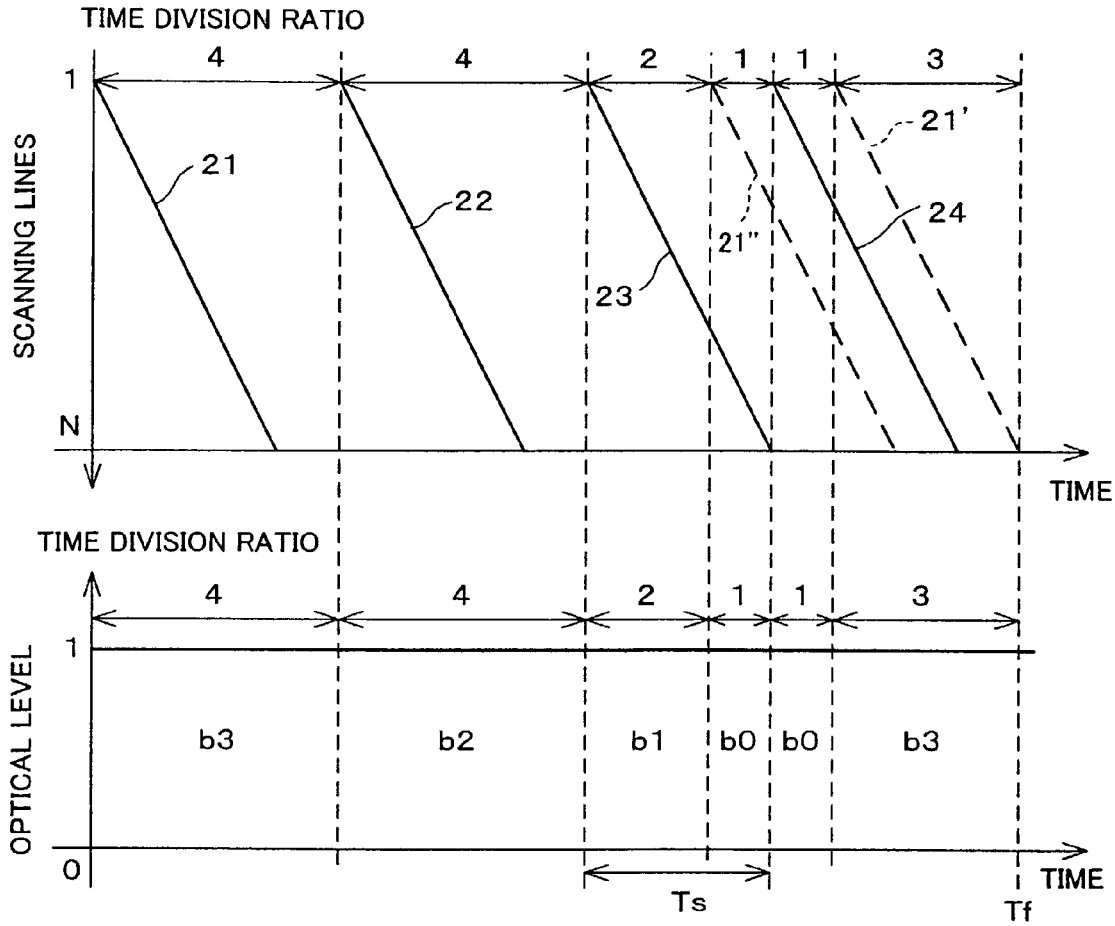
FIG. 15 is an explanatory view of scanning, indicating that the display element of FIG. 12 carries out 4-bit time division gray scale driving, when the scanning time is different from those of the driving in FIGS. 13 and 14.

Furthermore, as FIG. 15 illustrates, when the length of the scanning period Ts is arranged so as to be three times as much as the length of the sub field of the least significant bit, subsequent scanning cannot start until each of the scannings 21 through 24 finishes. Therefore, there is an idle period between the scanning 23 and the scanning 24, which is equivalent to the sub field period corresponding to a single bit.

During this idle period, the display element 1' in accordance with the present invention carries out the scanning 21" so as to output and display the data stored in the memory element A19.

In this manner, the time division ratio of the display is:

b3:b3:b2:b3:b0:b3=4:4:2:1:1:3

If the scannings 21' and 21" are started at different timing, it is possible to carry out the display with a different time division ratio.

For instance, if an arrangement such that the start of the scanning 24 is delayed and the scanning 21' is omitted is adopted, the time division ratio of the display can be set as:

b3:b3:b2:b3:b0=4:4:2:4:1

Alternatively, when the interval between the scanning 21" and the scanning 24 is altered, it is possible to adopt an arrangement as:

b3:b3:b2:b3:b0:b3=4:4:2:3:1:1

However, it is noted that the occurrence rate of the dynamic false contour varies in accordance with the change of the time division pattern so that it is preferable to adopt a time division pattern in which the sub field period corresponding to the scanning 21' is longer than the sub field period corresponding to the scanning 21".

Therefore, the following ratio is the best for the arrangement illustrated in FIG. 15:

b3:b2:b1:b3:b0:b3=4:4:2:1:1:3

Because of the above-mentioned factors restraining the start of the scannings, for realizing the time division ratio with which the dynamic false contour is minimized, the scanning period Ts is arranged as:

$$Ts/Tf \leqq 2^k/(2^N-1)$$

where a single field period is Tf, the number of gray scale display bits in total is N, the number of memory bits that the memory element can store is M, and k is an integer of a smaller one of either M or (N−1)/2.

When all lines are scanned by a line-sequential scanning method, at the beginning of the scanning, which is carried out in the same manner as the previous scanning, after the previous scanning of all lines is finished, a period Ts required for this one scanning has to meet a conditional expression as $Ts \leqq Tf/(2^N-1)$. In this expression, the value in the right side corresponds to the length of the shortest sub field period. If one scanning period is virtually shorter than the shortest sub field period, it is possible to carry out an additional scanning in the same manner, after the scanning of all lines is finished. In the present invention, a long sub field period is divided in two, and from the longest sub field, the sub fields are successively scanned in descending order. For instance, in the case of 6-bit gray scale display, the sub fields having the division ratio of 32(bS):16(b4):8(b3):4(b2):2(b1):1(b0) are subjected to the modification so that the longest sub field is divided in two and the resultant fields are provided at the first half and the second half of the sub fields. Thus, the division ratio of the sub fields becomes 16(b5):16(b4):8(b3):4(b2):2(b1):1(b0):16(Mb5*b*), where Mb5 indicates the information bit b5 stored in the memory. The output-scanning of the memory (fourth step) can be carried out independently of the normal scanning (third step) in which the memory is not used. Thus, during the periods of 1(b0) and 16(Mb5), the scanning of the fourth step starts with a delay equal to the shortest sub field period after the scanning of the third step. In this case, during the periods of 2(b1) and 1(b0), the scanning period of the third step is at the maximum length when $Ts=Tf\times 2/(2^N-1)$ is met. That is to say, the scanning period of the third step is at the maximum length when Ts corresponds to the sub field period of the bit b1.

Similarly, when two memories are adopted, the sub fields have the time division ratio of 16(b5):8(b4):8(b3):4(b2):2(b1):8(Mb4):1(b0):16(Mb5), and during the periods of 2(b1) and 8(Mb4), the scanning of the fourth step for outputting the bit Mb4 starts with a delay equal to the sub field period of the bit b1 after the scanning of the third step. This arrangement is identical with the arrangement during the periods of 1(b0) and 16(Mb5). In this case, the scanning period of the third step is at the maximum length when $Ts=Tf\times 2^2(2^N-1)$ is met. That is to say, the scanning period of the third step is at the maximum length when Ts corresponds to the sub field period of the bit b2.

As described above, the conditional expression above can be generalized such that the longest period Ts required for the scanning can be represented in accordance with the number M of the corresponding memory bits, as $Ts=Tf\times 2^M(2^N-1)$. However, since the longest sub field is successively divided in two so that the resultant fields are provided at the beginning and end of the sub fields and the fourth step is carried out after the scanning of the third step, it is not possible to carry out the sub-field arrangement of the memory outputs even if the number of the memory bits is increased, and hence the longest scanning period is: $Ts=Tf\times 2^{(N-1)/2}/(2^N-1)$.

For instance, when N=6 and M=3, the arrangement of the sub fields is as follows: 16(b5):8(b4):4(b3):4(b2):4(Mb3):2(b1):8(Mb4):1(b0):16(Mb5), and during the fields of 4(b3), 4(b2), and 4(Mb3), the scanning period of the third step is at the maximum length when $Ts=Tf\times 2^2/(2^N-1)$. This is because the sub fields for the display, which correspond to the bits b2 and b3 respectively so as to have the same length, are adjacently provided.

Incidentally, the sub fields when N=6 and M=3 may be alternatively arranged as: (i) 16(b5):8(b4):4(b3):4(b2):2(b1):4(Mb3):8(Mb4):1(b0):16(Mb5) or (ii) 16(b5):8(b4):4(b3):4(b2):2(b1):1(b0):4(Mb3):8(Mb4): 16(Mb5). Ts is equivalent to the period of the maximum time-division units 4(b2) in the arrangement (i), while Ts is equivalent to the maximum length 2(b1) in the arrangement (ii), so that the scanning period of the former is twice as much as the scanning period of the latter. In this manner, despite the maximum length of Ts varies in accordance with the arrangement, it is possible to meet the conditional expression above.

As described above, it is possible to arrange the scanning period as: $Ts=Tf\times 2^{(N-1)/2}/(2^N-1)$ by adding the memory bit.

In accordance with the arrangement above, the arrangement of the scanning period is formulated as: $Ts\leqq Tf\times 2^k/(2^N-1)$, where k is an integer of a smaller one of either M or (N−1)/2. On this account, the conditional expression: $Ts/Tf\leqq 2^k/(2^N-1)$ is derived.

In the present invention, Ts is arranged so as to meet the above-mentioned conditional expression. Therefore, the dynamic false contour is effectively restrained and plenty of time can be allocated for the scanning, and hence the drive frequency of the element can effectively be restrained and the power consumption can be reduced.

The description above shows the example in which the memory element A19 can store the data of 1 bit. However, in the case of adopting a memory which can store the data of more than one bit, adopting the method above makes it possible to restrain the dynamic false contour further effectively and carry out excellent multi-level gray scale display.

Now, referring to FIG. 12, the display element 1', in which a memory element A19 which can store 2 bits and a memory element B19' which can store 1 bit are provided, is taken as an example, and a gray scale driving method of this memory element 1' is described below.

In this display element 1', the display is carried out with 6-bit gray scale levels, and the time for scanning all lines once is equal to the length of the shortest sub field.

First, the selecting method of the sub fields according to the gray scale driving method of the above-mentioned display element can be formulated as follows.

1. In a single field period, the lines S1*n* are scanned as many as the number of the gray scale bits.
2. The memory element A19 stores gray scale information corresponding to significant bits.
3. After the scanning of the lines S1*n*, the lines S2*n* may be scanned before the next scanning starts.
4. The information bits which should be stored in the memory element A19 are scanned first and then displayed as well as stored in the memory element A19, and the memory data is outputted by the scanning of the line S2*n*.
5. The sub fields which are created by the division are distributed to the first half and the second half of one field period as equally as possible.

Figure 16:
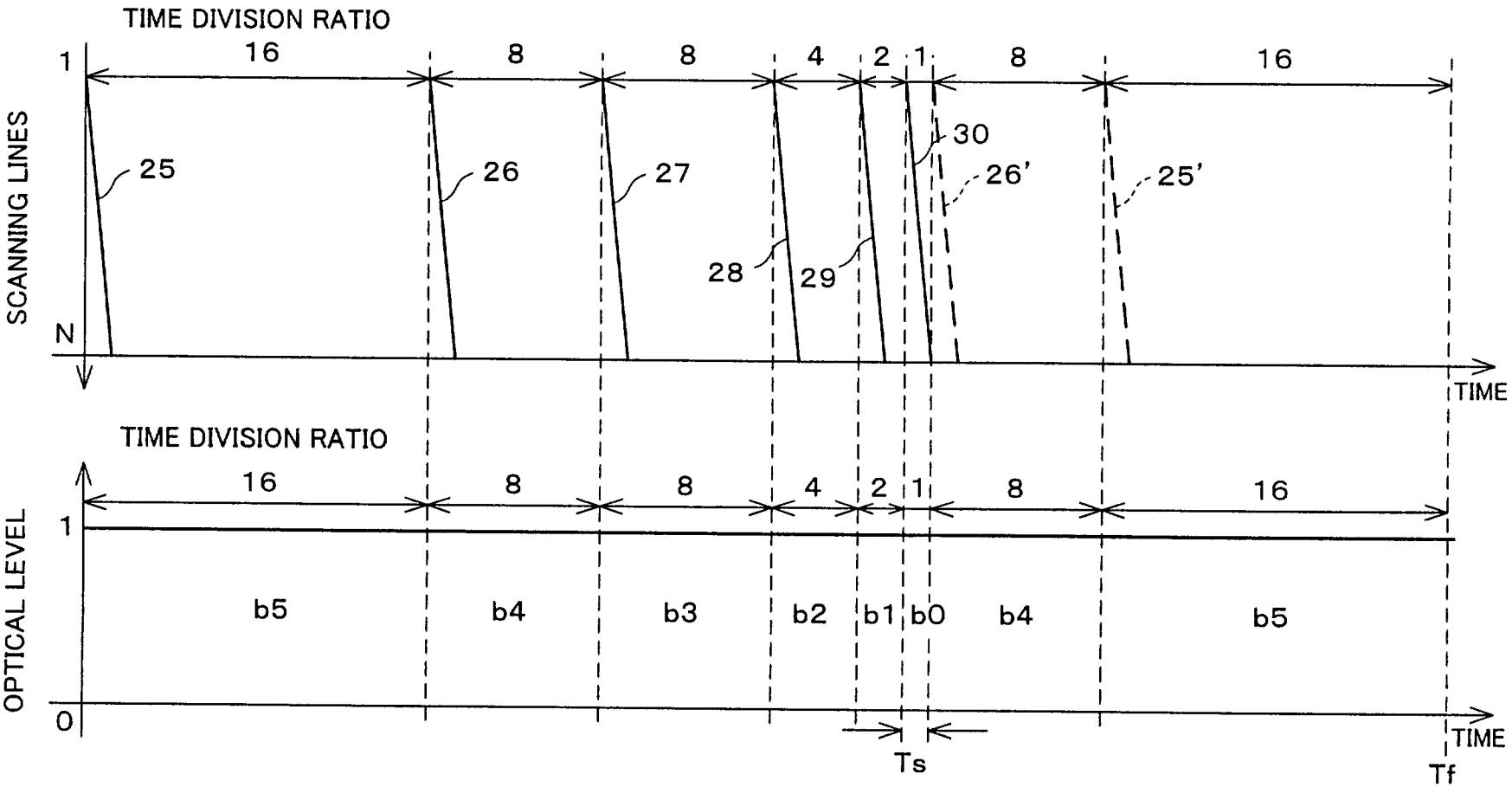
FIG. 16 is an explanatory view of scanning, indicating that the display element of FIG. 12 carries out 6-bit gray scale driving.

When the start time of the scanning of each sub field is determined in accordance with the procedures above, as FIG. 16 illustrates, the scannings corresponding to the respective bits are arranged such that the information bits b5 and b4 are displayed and stored in the memory element A19 by the scannings 25 and 26 respectively, and then the information bits b3 through b0 are stored in the memory element B19' by the respective scannings 27 through 30, each of the information bits b3 through b0 being kept until the time of the subsequent scanning.

After the scanning 30, a scanning 26' of the lines S2*n* is carried out after a lapse of a sub field (equal to Ts) which is equivalent to one gray scale level. Then after a lapse of 8 Ts periods, a scanning 25' of the lines S2*n* is carried out. In this manner, the ratio of the sub fields corresponding to the respective bits in one field period is:

b5:b4:b3:b2:b1:b0:b4:b5=16:8:8:4:2:1:8:16

As illustrated in Table 5, the absolute value of the gray scale error generated in a display device provided with the above-mentioned display element is 0.89-level gray scale. Thus, the gray scale inversion owing to the dynamic false contour does not occur when this driving method is adopted, so that images with good quality can be displayed.

TABLE 5

| | Ts PERIOD | SUB FIELD DIVISION RATIO (CORRESPONDING BITS) | NUMBER OF SUB FIELDS | MAXIMUM GRAY SCALE ERROR |
|---|---|---|---|---|
| EXAMPLE 4 | Tf/63 | 16(b5):8(b4):8(b3):4(b2):2(b1):1(b0):8(b4):16(b5) | 8 | 0.889 |
| EXAMPLE 3 | Tf/6 | 10.5(b5):10.5(b4):8(b3):2.5(b5): 4(b2):6.5(b5):2(b3):5.5(b4):3(b5):1(b0):9.5(b5) | 11 | 2.571 |

Figure 17:
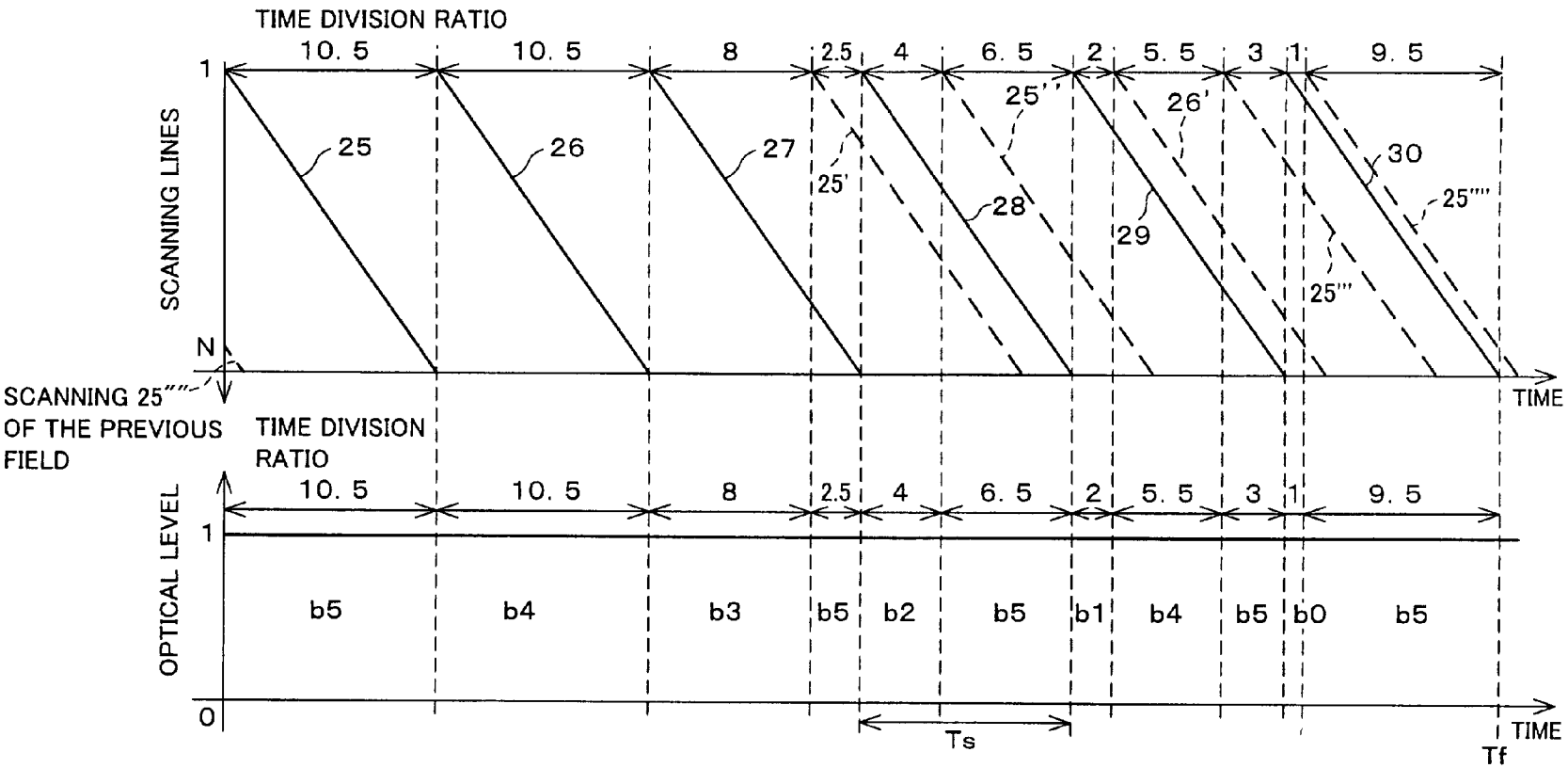
FIG. 17 is an explanatory view of scanning, indicating that a display element carries out 6-bit gray scale driving, when the scanning time is at the maximum.

In the display element adopting the gray scale driving method as above, when the scanning period Ts is ⅙ of one field period Tf, i.e. Tf=6×Ts, as FIG. 17 illustrates, the time required for scanning the lines S1*n* is the longest in carrying out the 6-bit gray scale drive. In this condition, the time required for scanning one line is 10.5 times longer than the time in the above-mentioned display element, so that the drive frequency of the display device can be lowered.

However, in the display element arranged like this, the number of the time division for the display increases so that 11 sub fields are required.

In this display element, first of all, the information bits b5 and b4 are stored in the memory element A19 and the display in accordance with these information bits is carried out, by the respective scannings 25 and 26. Then by the scanning 27, the information bit b3 is stored in the memory element B19', and the display in accordance with the information bit is carried out during the sub field period of 8 time-division units. Subsequently, by the scanning 25' of the lines S2*n*, the information bit b5 stored in the memory element A19 is supplied to the memory element B19' so as to be stored in the memory element B19', and at the same time the display in accordance with this information bit is carried out. After the sub field period of 2.5 time-division units, the scanning 28 of the lines S1*n* follows the scanning 27, so that the display in accordance with the information bit b3 is carried out.

In this manner, the scannings 25 through 30 of the lines S1*n* are successively carried out at intervals of the scanning period Ts, and when the sub field period required for the information bit bn is shorter than the scanning period Ts, the information bits b5 and b4 are divided so as to be displayed, by the scannings 25', 25", 25''', 25'''' and 26' of the lines S2*n*.

As a result, the relationship between the sub fields and the corresponding display bits is:

b5:b4:b3:b5:b2:b5:b1:b4:b5:b0:b5=10.5:10.5:8:2.5:4: 6.5:2:5.5:3:1:9.5

In this formula, the information bit b5 is divided in five and the information bit b4 is divided in two.

In this case, the absolute value of the gray scale error is, as shown in Table 5, 2.57-level gray scale. In this wise, in the display element in which the scanning period Ts is ⅙ of one field period Tf, i.e. Tf=6×Ts, the gray scale error is greater than that of the above-mentioned display element, so that the occurrence of the dynamic false contour cannot be restrained.

On this account, it is understood that the display element 1', in which the scanning period Ts is equal to the shortest sub field, can effectively restrain the occurrence of the dynamic false contour.

Moreover, assumed that the time required for scanning all lines is Ts, one field period is Tf, the number of the bits that the memory element A19 can store is M, and the number of gray scale display bits on the whole is N, the gray scale error, when the number of the time division is determined in accordance with the aforementioned formula for the display, is described as below with reference to Table 6.

TABLE 6

| DRIVE PATTERN # | NUMBER OF GRAY SCALE BITS N | NUMBER OF MEMORY BITS M | Tf/ $(Ts(2^N-1))$ | Ts/Tf ≦ $2^K/(2^N-1))$ | SUB FIELD DIVISION RATIO (CORRESPONDING BITS) | NUMBER OF SUB FIELDS | MAXIMUM GRAY SCALE ERROR |
|---|---|---|---|---|---|---|---|
| 1 | 6 | 1 | 1 | YES | 16(b5):16(b4):8(b3):4(b2):2(b1):1(b0):16(b5) | 7 | 3.810 |
| 2 | 6 | 1 | 2 | YES | 16(b5):16(b4):8(b3):4(b2):2(b1):1(b0):16(b5) | 7 | 3.810 |
| 3 | 6 | 1 | 3 | NO | 16(b5):16(b4):8(b3):4(b2):2(b1):1(b5):1(b0):15(b5) | 8 | 3.825 |
| 4 | 6 | 1 | 4 | NO | 16(b5):16(b4):8(b3):4(b2):2(b1):3(b5):1(b0):13(b5) | 8 | 3.857 |
| 5 | 6 | 1 | 6 | NO | 16(b5):16(b4):8(b3):4(b2):2(b5):2(b1):4(b5): 1(b0):10(b5) | 9 | 3.968 |
| 6 | 6 | 2 | 2 | YES | 16(b5):8(b4):8(b3):4(b2):2(b1):1(b0):8:(b4):16(b5) | 8 | 0.889 |
| 7 | 6 | 2 | 4 | YES | 16(b5):8(b4):8(b3):4(b2):2(b1):2(b4): 1(b0):6(b4):16(b5) | 9 | 0.921 |
| 8 | 6 | 2 | 4 | YES | 16(b5):8(b4):8(b3):4(b2):2(b1):8(b4):1(b0):16(b5) | 8 | 1.016 |
| 9 | 6 | 2 | 5 | NO | 16(b5):7(b4):8(b3):4(b2):1(b4):2(b1): 3(b4):1(b0):5(b4):16(b5) | 10 | 1.000 |
| 10 | 6 | 2 | 5.5 | NO | 16(b5):5.5(b4):8(b3):4(b2):1.5(b4): 2(b1):3.5(b4):1(b0):5.5(b4):16(b5) | 11 | 1.056 |
| 11 | 6 | 3 | 2 | YES | 16(b5):8(b4):4(b3):4(b2):2(b1):1(b0): 4(b3):8(b4):16(b5) | 9 | 0.190 |
| 12 | 6 | 3 | 3 | YES | 16(b5):8(b4):4(b3):4(b2):2(b1):1(b3): 1(b0):3(b3):8(b4):16(b5) | 10 | 0.206 |
| 13 | 6 | 3 | 4 | YES | 16(b5):8(b4):4(b3):4(b2):2(b1):4(b3): 1(b0):8(b4):16(b5) | 9 | 0.254 |
| 14 | 6 | 3 | 4.5 | NO | 16(b5):8(b4):4.5(b3):4(b2):1(b3): 2(b1):4.5(b3):1(b0):8(b4):16(b5) | 10 | 0.286 |

TABLE 6-continued

| DRIVE PATTERN # | NUMBER OF GRAY SCALE BITS N | NUMBER OF MEMORY BITS M | Tf/(Ts($2^N$−1)) | Ts/Tf ≦ $2^K/(2^N-1)$ | SUB FIELD DIVISION RATIO (CORRESPONDING BITS) | NUMBER OF SUB FIELDS | MAXIMUM GRAY SCALE ERROR |
|---|---|---|---|---|---|---|---|
| 15 | 8 | 1 | 2 | YES | 64(b7):64(b6):32(b5):16(b4):8(b3):4(b2):2(b1):1(b0):64(b7) | 9 | 15.81 |
| 16 | 8 | 1 | 3 | NO | 64(b7):64(b6):32(b5):16(b4):8(b3):4(b2):2(b1):1(b7):1(b0):63(b7) | 10 | 15.82 |
| 17 | 8 | 2 | 2 | YES | 64(b7):32(b6):32(b5):16(b4):8(b3):4(b2):2(b1):1(b0):32(b6):64(b7) | 10 | 3.769 |
| 18 | 8 | 2 | 4 | YES | 64(b7):32(b6):32(b5):16(b4):8(b3):4(b2):2(b1):2(b6):1(b0):30(b6):64(b7) | 11 | 3.898 |
| 19 | 8 | 2 | 4 | YES | 64(b7):32(b6):32(b5):16(b4):8(b3):4(b2):2(b1):32(b6):1(b0):64(b7) | 10 | 4.016 |
| 20 | 8 | 2 | 5 | NO | 64(b7):32(b6):32(b5):16(b4):8(b3):4(b2):1(b6):2(b1):31(b6):1(b0):64(b7) | 11 | 4.024 |
| 21 | 8 | 3 | 2 | YES | 64(b7):32(b6):16(b5):16(b4):8(b3):4(b2):2(b1):1(b0):16(b5):32(b6):64(b7) | 11 | 0.941 |
| 22 | 8 | 3 | 6 | YES | 64(b7):32(b6):16(b5):16(b4):8(b3):4(b2):16(b5):2(b1):32(b6):1(b0):64(b7) | 11 | 1.255 |
| 23 | 8 | 3 | 8 | YES | 64(b7):32(b6):16(b5):16(b4):8(b3):4(b2):16(b5):2(b1):32(b6):1(b0):64(b7) | 11 | 1.255 |
| 24 | 8 | 3 | 9 | NO | 64(b7):32(b6):16(b5):16(b4):8(b3):1(b5):4(b2):15(b5):2(b1):32(b6):1(b0):64(b7) | 12 | 1.271 |
| 25 | 8 | 3 | 12 | NO | 64(b7):32(b6):16(b5):16(b4):8(b3):4(b5):4(b2):12(b5):2(b1):32(b6):1(b0):64(b7) | 12 | 1.318 |

In Table 6, numerical values in the column Tf/(Ts($2^N$−1)) indicate the length ratio of the scanning period Ts with reference to the sub field period for the display with the least significant bit. For instance, Table 6 shows that the scanning period Ts is equal to the shortest sub field in a drive pattern #1, and the scanning period Ts is twice longer than the shortest sub field in a drive pattern #2.

In each of the drive patterns, the maximum value of the gray scale error (in this case, visible gray scale error when the gray scale level of a domain is different from that of the adjacent domain by one gray scale level and an image moves at a rate of one pixel per field) is more or less consistent when the number of the memory bits used in each of the drive patterns is identical, and when the length ratio of the scanning period Ts is relatively increased, the gray scale error is prone to increase. This is because the sub fields corresponding to significant bits to be outputted, which are stored in the memory, are required to be divided, due to the increase of the length ratio of the scanning period Ts.

To minimize the maximum gray scale error due to the dynamic false contour without increasing the number of the sub fields as much as possible, for optimizing the output of the memory bits, it is preferable to shorten the scanning period Ts as much as possible. However, when at least the following conditional expression:

$$Ts/Tf > 2^k/(2^N-1)$$

is met, the gray scale error can be minimized.

Incidentally, k indicates an integer of a smaller one of either M or (N−1)/2.

In Table 6, Yes/No indicates whether the conditional expression above is met or not. For instance, in Table 6, a drive pattern #6 is the condition in which the gray scale error is minimized, among drive patterns #6-#8.

Despite the time-division unit of the scanning period Ts is 2 in this case, the time division ratio is not varied even if the time-division units is less than 2, so that the display with the same quality can be obtained. When the time-division unit of the scanning period Ts is 4, the value of the gray scale error varies in accordance with the timing of the output of the information bit b4 stored in the memory. The value of the gray scale error in the drive pattern #8 is greater than that of the drive pattern #7, since the 8-time-unit sub field corresponding to the information bit b4 is provided before the sub field corresponding to the information bit b0 in the drive pattern #8. In this case, the value of the gray scale error is smaller in the drive pattern #7 so that the drive pattern #7 should be chosen.

Incidentally, Table 6 illustrates that in the drive patterns in which the conditional expression Ts/Tf≦$2^k/(2^N-1)$ is not met, i.e. the judgment is No, the number of the sub fields is greater than the number of the sub fields in the drive patterns in which the judgment is Yes. Moreover, as in Example 3, if the number of the time-division units of the scanning period Ts is increased as much as possible, it is expected that the value of the gray scale error increases so as not to be negligible, as illustrated in Table 5.

As described above the display element 1' in accordance with the present invention is arranged so that, to restrain the gray scale error as much as possible, the time required for scanning all lines once is arranged to be short in order to meet the conditional expression, and hence the occurrence of the dynamic false contour is restrained effectively and excellent multi-level gray scale display can be carried out.

Moreover, the gray scale driving method of the display element in accordance with the present invention may be arranged such that, in the display element including: a first and second electrodes intersecting with each other; an electric optical modulation element provided at a point of the junction of the first and second electrodes; a memory element for storing M-bit (M≧1) information; and an active element, when scanning is repeated K times (K≧1) at a predetermined intervals in one field period, the memory element stores M-bit information at the maximum from image information in each scanning, and the optical modulation element keeps the display with M-bit gray scale in accordance with the information stored in the memory element, until the next scanning.

Moreover, the gray scale driving method of the display element as above may be arranged such that, when no scanning is carried out in one field period, the memory element stores image information of first M bits of image signals at the time of carrying out the scanning in a field period immediately before the field period in which no scanning is carried out, so that the optical modulation element keeps the display with M-bit gray scale, in accordance with the information stored in the memory element.

Moreover, the gray scale driving method of the display element as above may be arranged such that, when scanning is repeated more than once at a predetermined intervals in one field period, the sub field with the greatest weight is divided into a plurality of divided sub fields and the divided sub fields are provided in the first half and the second half of the field period respectively, and also, scanning is repeated K times ($K \geqq 2$) at a predetermined intervals in one field period, and in the scanning above, the memory element stores M-bit image information in accordance with the supplied image signal, so that the optical modulation element keeps the display with M-bit gray scale in accordance with the information stored in the memory element, until the next scanning is carried out.

Moreover, the gray scale driving method of the display element above may be arranged such that, when the total number of the gray scale signal information bits is N, the number of the memory bits is M, and the number of scannings in one field period is K, F-bit additional information which meets $F=M\times K-N$ is added to the image information.

Moreover, the gray scale driving method of the display element in accordance with the present invention may be arranged such that, in the display element, provided at a point of the junction of first and second electrodes intersecting with each other, including: an electric optical modulation element; a memory element; and an active element, the memory condition of the memory element is set by the first scanning, the display condition of the electric optical modulation element is set by the second scanning, and being independent from the procedure in the second scanning, the display condition of the optical modulation element is set using the information which has been stored in the memory element, by the third scanning, wherein the interval between the first scanning and the second scanning is substantially identical with half of the sub field corresponding to the bit used for determining the display condition above.

Moreover, the gray scale driving method of the display element above may be arranged such that, when: the time required for successively scanning all lines is Ts; one field period is Tf; the total number of the gray scale signal information bits is N; and the number of bits stored in the memory element is M, $Ts/Tf \leqq 2^k/(2^N-1)$ where k is an integer either smaller one of M and $(N-1)/2$ is met.

Moreover, the gray scale driving method of the display element above may be arranged such that, when the total number of gray scale signal information bits is N and a J-th bit of the gray scale signal information which is stored in the storage means is to be outputted, at the time of outputting a k-th gray scale signal information bit in the second scanning, the bit number J of the gray scale signal information, which is outputted in the third scanning immediately before or immediately after the second scanning, meets $k+J=N-1$.

Moreover, the gray scale driving method of the display element above may be arranged such that, when the bit number of the gray scale signal information, which is outputted in the third scanning immediately before the second scanning, is equal to the bit number of the gray scale signal information, which is outputted in the third scanning immediately after the second scanning, the sub field immediately after the second scanning is longer than the sub field immediately before the second scanning.

Also, when scanning is repeated more than once in one field period, it is preferable that the sub field with the greatest weight is divided into a plurality of divided display fields, and the divided display fields are provided in the first half and the second half of the field period respectively, so that the scannings are carried out.

On this account, when the display is carried out using a plurality of fields in which the weight is the power of 2, controlling the display pattern (on/off) of the field with the greatest weight makes it possible to restrain the occurrence of the dynamic false contour.

That is to say, the dynamic false contour becomes visible due to the synergistic effect of (i) the amount of travel of the luminous barycenter within the field period being maximized in the sub field with the greatest weight and (ii) the luminous barycenter and the sight line of the viewer moving in accordance with the movement of images. Thus, the sub field with the greatest weight is divided in at least two and the resultant fields are provided in the first half and the second half of the whole field period respectively, so that the luminous barycenter becomes more or less consistent regardless of the display condition of the sub field with the greatest weight, and hence the occurrence of the dynamic barycenter can be restrained.

Incidentally, in the case of the display using the field period with the weight of the powers of 2, in addition to the field with the greatest weight, the second and third heaviest fields are also divided in at least two, for preventing the variation of the luminous barycenter. On this account, the prevention of the occurrence of the dynamic false contour can be further ensured.

Especially, in the case of a display element including a pixel memory capable of storing M-bit information, since dividing the field with the greatest weight in two is equivalent to the division of the fields having the greatest weight to M-th greatest weight respectively, the prevention of the occurrence of the dynamic false contour can be further accentuated.

Furthermore, when scanning is not carried out in the whole field period, it is preferable that by the scanning immediately before the suspension of the scanning, the storage means stores the gray scale signal information of first M bits and the optical modulation element keeps the display with $2^M$-level gray scale.

On this account, even if scanning is not carried out in the whole field period, it is possible to keep the condition of multi-level gray scale display without updating images, and it is unnecessary to carry out data transfer and the output of scanning signals, compared with the multi-field display. Thus, the load of the driver can be reduced, and moreover, the power consumption of the display device can be decreased due to the reduction of the frequency of data transfer and the frequency of the output of scanning signals.

Moreover, when the total number of the gray scale signal information bits is N, the number of the memory bits is M, and the number of scannings in one field period is K, it is preferable to add F-bit additional information which meets $F=M\times K-N$ to the gray scale signal information so as to output this gray scale signal information.

On this account, when the additional information bits meeting the conditional expression above is added to the image information, it is possible to carry out the output whose display luminescence is adjusted in accordance with the display condition of images.

That is to say, when the storage means can store M-bit information, the display with $2^M$-level gray scale at the maximum can be carried out in the case of the divided sub fields as above, and thanks to the combination of K divided sub fields with an appropriate weight, it is substantially possible to carry out the display using M×K bits. Thus, since F-bit additional information which meets F=M×K−N is arranged so as to be added to the image information, when an average luminance level of the displayed image is low so that the displayed image gives dark impression on the whole, it is possible to adjust the gray scale level brighter by selecting the additional information bits, so as to display a glittering image, within the range of signal electrode lines required for storing gray scale signal data. Also, the additional information bits can be used for emphasizing the edges in the image and overlaying texts on the image.

However, it is noted that there is no redundancy in the minimum number of fields, when a certain number of bits is adopted for the gray scale display. In this case, adding one more sub field, i.e. adding 1 to the value K enables to provide the additional information bits.

To solve the above-identified objective, the display element in accordance with the present invention, provided at each point of intersections of a plurality of signal lines and a plurality of scanning lines, includes: an optical modulation element; an active element; control means for (i) dividing sub fields with great weights into a plurality of divided sub fields, (ii) providing the divided sub fields in a first half and a second half of one field period respectively, and (iii) conducting scannings; first storage means for storing gray scale signal information corresponding to the sub fields with the great weights; and second storage means for storing gray scale signal information except the gray scale signal information corresponding to the sub fields with the great weights.

According to the arrangement above, the control means divides the sub fields, which scan the gray scale signal information of significant bits influencing on the occurrence of the dynamic false contour, into a plurality of divided sub fields so that the occurrence of the dynamic false contour can be restrained.

Also, since the first and second storage means store (i) the gray scale signal information of the significant bits and (ii) the gray scale signal information other than (i) respectively, the data after the scanning of pixels is not attenuated so that the signals can be supplied from the first and second storage means to the optical modulation element and the display condition can be kept. On this account, the frequency of the output and the load of the driver for gray scale drive can be reduced, and the power consumption can be decreased.

Moreover, since the first storage means stores the gray scale signal information of the significant bits in the divided field period in which the same scanning is repeated, when the scanning is repeated, the gray scale signal information stored in the first storage means is outputted to the optical modulation element so that the frequency of the output and the load of the driver for gray scale drive can be reduced, and the power consumption can be decreased.

Moreover, each of the above-mentioned sub fields is preferably divided into two identical periods, and this makes it possible to maximize the effect of the restraint of the dynamic false contour.

Moreover, when a time required for scanning all lines is Ts, one field period is Tf, a total number of gray scale signal information bits is N, and a number of memory bits of the first storage means is M, it is preferable that $Ts/Tf \leqq 2^k/(2^N-1)$, where k is an integer either smaller one of M and (N−1)/2, is met.

On this account, since the time required for scanning all lines is arranged so as to meet the conditional expression above, the frequency of the scanning can be reduced as much as possible, and the divided sub fields, which are arranged for restraining the dynamic false contour, are allowed to be provided.

Incidentally, the above-identified conditional expression is created to fulfill the reduction of the frequency of the scanning as well as the restraint of the dynamic false contour.

To achieve the above-identified objective, the gray scale driving method of the display element in accordance with the present invention is arranged such that the display element is provided at each point of intersections of a plurality of signal lines and a plurality of scanning lines and includes an optical modulation element, an active element, and storage means for storing M-bit (M≧1) information, and the gray scale driving method includes the steps of: storing M-bit gray scale signal information at a maximum, which is extracted from image information, in the storage means in each scanning when scanning is carried out K times (K≧1) in one field period; and keeping a display with M-bit gray scale level by means of the optical modulation element, based on the gray scale signal information stored in the storage means, until a subsequent scanning is carried out.

According to this gray scale driving method, the storage means stores M-bit information for preventing the attenuation of the display data after the scanning of pixels, so that the display condition can be kept.

That is, when scanning for displaying moving images, etc. is carried out, the display is carried out in accordance with each scanning, and by storing the gray scale signal information associated with the scanning in the storage means, the gray scale signal information can be supplied from the storage means to the optical modulation element even after the scanning, so that the optical modulation element can keep the display with $2^M$-level gray scale.

Thus, since it is unnecessary to resend the gray scale signal information for keeping the display condition of the optical modulation element after the scanning, the driver for gray scale drive can be made inactive, and the load of the driver can be reduced. Furthermore, since the frequency of transferring the gray scale signal data and the frequency of outputting the scanning signals can be reduced, it is possible to decrease the power consumption of the display device.

To achieve the above-identified objective, the gray scale driving method of the display element in accordance with the present invention, in which the element is provided at each point of intersections of a plurality of signal lines and a plurality of scanning lines and includes an optical modulation element and an active element, includes the steps of: (i) dividing sub fields, which are for scanning gray scale information corresponding to significant bits among supplied gray scale signal information, into a plurality of divided sub fields, so as to provide the divided sub fields in a first half and a second half of one field period respectively; (ii) storing the gray scale signal information corresponding to the significant bits in first storage means, and storing gray scale information except the gray scale signal information corresponding to the significant bits in second storage means; (iii) outputting the supplied gray scale signal information to the optical modulation element, so as to carry out a display; and (iv) outputting the gray scale signal information corresponding to the significant bits, the information stored in the first storage means, to the optical modulation element, so as to carry out a display.

According to this gray scale driving method, each of the sub fields which scan the gray scale signal information of significant bits influencing on the occurrence of the dynamic false contour is divided into a plurality of divided sub fields, so that the occurrence of the dynamic false contour can be restrained.

Moreover, since the first and second storage means store (i) the gray scale signal information of the significant bits and (ii) the gray scale signal information other than (i) respectively, the data after the scanning of pixels is not attenuated so that the signals can be supplied from the first and second storage means to the optical modulation element and the display condition can be kept. On this account, the frequency of the output and the load of the driver for gray scale drive can be reduced, and the power consumption can be decreased.

Furthermore, since the first storage means stores the gray scale signal information of the significant bits in a field period in which the same scanning is repeated, when the scanning is repeated, the gray scale signal information stored in the first storage means is outputted to the optical modulation element so that the frequency of the output and the load of the driver for gray scale drive can be reduced, and the power consumption can be decreased.

Moreover, it is preferable that when: the number of all gray scale bits is N; the gray scale bits are given numbers as 0, 1, . . . , N−1 from a less significant bit to a more significant bit; bits of the gray scale signal information, which are stored in the storage means and to be outputted, are last J bits; and at the time of outputting the gray scale signal information of last k bits in the step (iii), J-bit gray scale signal information, which is outputted in the step (iv) immediately before and/or immediately after the step (iii), meets k+J=N−1.

On this account, the occurrence of the dynamic false contour can be restrained as much as possible.

That is to say, the conditional expression above defines the timing when the gray scale signal information of not less than 2 bits should be outputted, thus, for instance, provided that: the memory bit M is 2, i.e. M=2; 6th bit ($M_1=Z_6$) from the least significant bit of gray scale signal information Z is designated as a bit $M_1$; and 5th bit ($M_2=Z_4$) from the least significant bit of the gray scale signal information Z is designated as a bit $M_2$, when, for instance, the gray scale signal information 2 where the number of the gray scale levels N=6 is supplied, the information of $Z_k$, where k=5, 4, . . . , 0, is supplied to the optical modulation element from the higher bit to the lower bit.

When the bit number K=5 is supplied in the step (iii), the step (iv) is not carried out so that the bit number k=4 is supplied in the step (iii) again, after the display finishes.

The timing of outputting the information corresponding to the memory bits M is after the bit either K=3, 2, 1, or 0, where k<N−M=4, is outputted. In this arrangement, (I) the display timing $Z_0$ of the shortest field period is adjacent to the display timing $Z_5$ of the longest sub field in which the output should be carried out using the memory $M_1$, in the second half and (II) the display timing of $Z_1$ of the second shortest sub field period is adjacent to the display timing $Z_4$ of the second longest sub field period in which the output should be carried out using the memory $M_2$, in the second half. On this account, the luminous barycenters of the respective sub fields come close to each other in the field period so that the dynamic false contour can be restrained.

As described above, it is understood that when the adjacence of the display timings is mathematized, the display $Z_j$ ($M_1=Z_5$, $M_2=Z_4$ in the example above) in the step (iv), which is arranged immediately before or after the display $Z_k$ that should be displayed in the step (iii), preferably meets k+j=N−1.

Moreover, when the bit number of the gray scale signal information outputted in the step (iv) immediately before the step (iii) is equal to the bit number of the gray scale signal information outputted in the step (iv) immediately after the step (iii), the sub field of the step (iv) immediately after the step (iii) is preferably longer than the sub field of the step (iv) immediately before the step (iii).

On this account, when the display information $Z_j$ in the step (iv) immediately before the display $Z_k$ in the step (iii) is equal to the display information $Z_j$ in the step (iv) immediately after the display $Z_k$ in the step (iii), the sub field immediately after the display $Z_k$ is arranged so as to be longer than the sub field immediately before the display $Z_k$, so that the luminous barycenters of the respective sub fields come close within one field period and hence it is possible to restrain the dynamic false contour.

To achieve the above-identified objective, the gray scale driving method in accordance with the present invention is arranged such that a display element, provided at each point of intersections of a plurality of signal lines and a plurality of scanning lines, includes: an optical modulation element; an active element; and storage means for storing M-bit (M≧1) information, wherein, (i) when scanning is carried out K times (K≧1) at a predetermined ratio of intervals in one field period, in each scanning, the storage means stores M-bit gray scale signal information at a maximum from image information, (ii) until a subsequent scanning is carried out, the optical modulation element keeps a display with M-bit-level gray scale, based on the gray scale signal information stored in the storage means, and (iii) a sub field with a greatest weight is divided into a plurality of divided sub fields, the divided sub fields are provided in a first half and a second half of one field period respectively, and scannings are carried out.

According to this arrangement, the gray scale drive is arranged such that the longest field period, which has an effect on the occurrence of the dynamic false contour, is divided in two and the shortest field period is provided between the resultant two sub fields. On this account, it is possible to restrain the occurrence of the dynamic false contour.

That is to say, when the display using a plurality of fields with the weight of the powers of 2 is carried out, the dynamic false contour occurs in accordance with the display pattern (lighting or non-lighting) of the field with the greatest weight. That is, the dynamic false contour dynamic false contour becomes visible owing to the synergistic effect of (i) the amount of travel of the luminous barycenter within the field period being maximized in the period of the greatest weight and (ii) the luminous barycenter and the sight line of the viewer moving in accordance with the movement of images.

Thus, the display element in accordance with the present invention is arranged such that the sub field with the greatest weight is divided at least in two and the resultant sub fields are provided in the first half and the second half of the whole field period, respectively. On this account, the luminous barycenter is arranged so as to be more or less consistent regardless of the display pattern of the field with the greatest weight, and hence it is possible to effectively restrain the occurrence of the dynamic false contour.

Moreover, since the storage means which stores M-bit information is provided, the gray scale display keeping means can keep the display condition without attenuating the condition of the display data after the scanning of pixels.

That is to say, the display element in accordance with the present invention is arranged so that, when the scanning of moving images, etc. is carried out, the display is carried out in each scanning, and at the same time the gray scale signal information of each scanning is stored in the storage means. Thus the gray scale signal information can be supplied from the storage means to the optical modulation element even after the scanning, so that the display of the optical modulation element can be kept at the display with $2^M$-level gray scale.

Therefore, since it is unnecessary to resend the gray scale signal information for keeping the display of the optical modulation element after the scanning, the driver for gray scale drive can be made inactive and the load of the driver can be reduced. Moreover, since the frequency of transferring the gray scale signal data and the frequency of outputting the scanning signals can be reduced, the power consumption of the display device can be decreased.

Moreover, it is preferable that when no scanning is carried out in one field period, the storage means stores gray scale signal information of first M bits at a time of an immediately preceding scanning in a previous field period, so that the optical modulation element keeps a display with $2^M$-level gray scale.

On this account, even if no scanning is carried out in one field period, it is possible to keep the multi-level gray scale display without updating images, and unlike the case in which the display using a plurality of fields is carried out, it is unnecessary to carry out the data transfer and the output of the scanning signals. Thus, since the load of the driver, the frequency of the data transfer, and the frequency of outputting the scanning signals can be reduced, the power consumption of the display device can be decreased.

Moreover, it is preferable that when a total number of gray scale signal information bits is N, a number of memory bits is M, and a number of scannings in one field period is K, F-bit additional information which meets $F=M\times K-N$ is added to the gray scale signal information so that the gray scale signal information is outputted.

On this account, when the additional information bits which meet the conditional expression above are added to the image information, the output with the display luminance adjusted in accordance with the display condition of the images can be carried out.

Namely, when the storage means can store M-bit information, the display with $2^M$-level gray scale display can be carried out in the divided sub fields, and since K sub fields each having an appropriate weight are combined, the display with M×K gray scale levels is practically carried out. Thus, since F-bit additional information which meets $F=M\times K-N$ is arranged so as to be added to the image information, even if an average luminance level of the displayed image is low so that the displayed image gives dark impression on the whole, it is possible to adjust the gray scale level brighter by selecting the additional information bits and display a glittering image, within the range of signal electrode lines which are necessary for storing the gray scale signal data. Furthermore, the additional information bits can be used for emphasizing the edges in the image and overlaying texts on the image.

However, it is noted that there is no redundancy in the minimum number of fields, when a certain number of bits is adopted for the gray scale display. In this case, adding one more sub field, i.e. adding 1 to the value K enables to provide the additional information bits.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A display element, provided at each point of intersections of a plurality of signal lines and a plurality of scanning lines, comprising:

an optical modulation element;

an active element;

storage means for storing M-bit ($M\geqq 1$) information at a maximum in each scanning, until a subsequent scanning, the optical modulation element keeping a display with $2^M$-level gray scale, based on gray scale signal information stored in the storage means; and wherein, when scanning is carried out more than once in one field period, a sub field with a greatest weight is divided into a plurality of divided sub fields and the plurality of display fields are provided in a first half and a second half of said one field period respectively, so that scannings are carried out.

2. A display element, provided at each point of intersections of a plurality of signal lines and a plurality of scanning lines, comprising:

an optical modulation element;

an active element;

control means for (i) dividing sub fields with great weights into a plurality of divided sub fields, (ii) providing the divided sub fields in a first half and a second half of one field period respectively, and (iii) conducting scannings;

first storage means for storing gray scale signal information corresponding to the sub fields with the great weights; and second storage means for storing gray scale signal information except the gray scale signal information corresponding to the sub fields with the great weights.

3. The display element as defined in claim 2, wherein each of the sub fields is divided into two identical periods.

4. The display element as defined in claim 2, wherein, when a time required for scanning all lines is Ts, one field period is Tf, a total number of gray scale signal information bits is N, and a number of memory bits of the first storage means is M, $Ts/Tf\leqq 2^k/(2^N-1)$ where k is an integer either smaller one of M and $(N-1)/2$ is met.

5. A gray scale driving method of a display element which is provided at each point of intersections of a plurality of signal lines and a plurality of scanning lines and includes an optical modulation element and an active element, comprising the steps of:

(i) dividing sub fields, which are for scanning gray scale information corresponding to significant bits among supplied gray scale signal information, into a plurality of divided sub fields, so as to provide the divided sub fields in a first half and a second half of one field period respectively;

(ii) storing the gray scale signal information corresponding to the significant bits in first storage means, and storing gray scale information, except the gray scale signal information corresponding to the significant bits, in second storage means;

(iii) outputting the gray scale signal informationstored in the second storage means to the optical modulation element, so as to carry out a display; and (iv) outputting the gray scale signal information corresponding to the significant bits, the information stored in the first storage means, to the optical modulation element, so as to carry out a display.

6. The gray scale driving method of the display element as defined in claim 5, wherein, when: a number of all gray scale bits is N; the gray scale bits are given numbers as 0, 1, . . . , N−1 from a less significant bit to a more significant bit; and the gray scale signal information bits, which are stored in the storage means and to be outputted, are last J bits, at a time of outputting the gray scale signal information of last k bits in the step (iii), J-bit gray scale signal information, which is outputted in the step (iv) immediately before and/or immediately after the step (iii), meets k+J=N−1.

7. The gray scale driving method of the display element as defined in claim 6, wherein, when the number of gray scale signal information bits which are outputted in the step (iv) immediately before the step (iii) is equal to the number of gray scale signal information bits which are outputted in the step (iv) immediately after the step (iii), a sub field immediately after the step (iii) is longer than a sub field immediately before the step (iii).

8. A display element, provided at each point of intersections of a plurality of signal lines and a plurality of scanning lines, comprising:

an optical modulation element;

an active element; and storage means for storing M-bit (M≧1) information, wherein, (i) when scanning is carried out K times (K≧1) at a predetermined intervals in one field period, in each scanning, the storage means stores M-bit (M≧1) gray scale signal information at a maximum, which is extracted from image information, (ii) until a subsequent scanning is carried out, the optical modulation element keeps a display with M-bit gray scale level, based on the gray scale signal information stored in the storage means, and (iii) a sub field with a greatest weight is divided into a plurality of divided sub fields, the divided sub fields are provided in a first half and a second half of one field period respectively, and scannings are carried out.

9. A display element, provided at each point of intersections of a plurality of signal lines and a plurality of scanning lines, comprising:

an optical modulation element;

an active element;

storage means for storing M-bit (M≧1) information at a maximum, when a scanning is carried out at least once at predetermined intervals in one field period;

gray scale display keeping means for making the optical modulation element keep a display with $2^M$-level gray scale based on gray scale signal information stored in the storage means, until a subsequent scanning is carried out; and wherein, when a plurality of scannings are carried out in one field period at a predetermined intervals, a sub field with a greatest weight is divided into a plurality of divided sub field and the plurality of divided sub field are provided in a first half and a second half of the field period respectively, so that the scannings are carried out.

10. A display element, provided at each point of intersections of a plurality of signal lines and a plurality of scanning lines, comprising:

an optical modulation element;

an active element;

control means for (i) dividing sub fields with great weights into a plurality of divided sub fields, (ii) providing the divided sub fields equally in a first half and a second half of one field period respectively, and (iii) conducting scannings;

first storage means for storing gray scale signal information corresponding to the sub fields with the great weights; and second storage means for storing gray scale signal information except the gray scale signal information corresponding to the sub fields with the great weights.

11. A gray scale driving method of a display element which is provided at each point of intersections of a plurality of signal lines and a plurality of scanning lines and includes an optical modulation element and an active element, comprising the steps of:

(i) dividing sub fields, which are for scanning gray scale information corresponding to significant bits among supplied gray scale signal information, into a plurality of divided sub fields, so as to equally provide the divided sub fields in a first half and a second half of one field period respectively;

(ii) storing the gray scale signal information corresponding to the significant bits in first storage means, and storing gray scale information, except the gray scale signal information corresponding to the significant bits, in second storage means;

(iii) outputting the gray scale signal information stored in the second storage means to the optical modulation element, so as to carry out a display; and (iv) outputting the gray scale signal information corresponding to the significant bits, the information stored in the first storage means, to the optical modulation element, so as to carry out a display.

12. The gray scale driving method of the display element as defined in claim 11, wherein, a number of all gray scale bits is N and a J-th bit of the gray scale signal information which is stored in the storage means is to be outputted, and at a time of outputting a k-th bit of the gray scale signal information in the step (iii), a bit number J of the gray scale signal information, which is outputted in the step (iv) immediately before and/or immediately after the step (iii), meets k+J=N−1.

13. The gray scale driving method of the display element as defined in claim 12, wherein, when a bit number of gray scale signal information which is outputted in the step (iv) immediately before the step (iii) is equal to a bit number of gray scale signal information which is outputted in the step (iv) immediately after the step (iii), a sub field immediately after the step (iii) is longer than a sub field immediately before the step (iii).

* * * * *